US009255716B2

(12) United States Patent
Koga et al.

(10) Patent No.: US 9,255,716 B2
(45) Date of Patent: Feb. 9, 2016

(54) IN-CEILING MOUNT TYPE AIR CONDITIONER AND INDOOR UNIT THEREOF

(75) Inventors: Seiichi Koga, Ota (JP); Nobuhiro Ogura, Kiryu (JP); Yoshikazu Hayashi, Ora-gun (JP)

(73) Assignee: Panasonic Intellectual Property Management Co., Ltd., Osaka-shi (JP)

( * ) Notice: Subject to any disclaimer, the term of this patent is extended or adjusted under 35 U.S.C. 154(b) by 1084 days.

(21) Appl. No.: 12/180,136

(22) Filed: Jul. 25, 2008

(65) Prior Publication Data

US 2009/0025414 A1 Jan. 29, 2009

(30) Foreign Application Priority Data

Jul. 25, 2007 (JP) ..... 2007-192761
Jul. 25, 2007 (JP) ..... 2007-192762
Aug. 6, 2007 (JP) ..... 2007-203776
Aug. 6, 2007 (JP) ..... 2007-203822

(51) Int. Cl.
*F25D 23/12* (2006.01)
*F25D 17/06* (2006.01)
(Continued)

(52) U.S. Cl.
CPC ..... *F24F 1/0007* (2013.01); *F24F 13/14* (2013.01); *F24F 13/20* (2013.01); *F24F 13/32* (2013.01);
(Continued)

(58) Field of Classification Search
CPC ..... F24F 2001/0037; F24F 11/0009; F24F 2013/1433
USPC ..... 62/259.1, 263, 411, 412, DIG. 16, 426
See application file for complete search history.

(56) References Cited

U.S. PATENT DOCUMENTS 6,089,972 A 7/2000 Gunji et al.
6,370,907 B1 * 4/2002 Sekiguchi et al. ..... 62/407
(Continued)

FOREIGN PATENT DOCUMENTS

EP 0950867 10/1999
EP 1139034 10/2001
(Continued)

OTHER PUBLICATIONS

Japanese Office Action dated Nov. 1, 2011, issued in corresponding Japanese Patent Application No. 2007-192762.
(Continued)

*Primary Examiner* — Mohammad M Ali
*Assistant Examiner* — Daniel C Comings
(74) *Attorney, Agent, or Firm* — Westerman, Hattori, Daniels & Adrian, LLP

(57) ABSTRACT

An indoor unit of an in-ceiling mount type air conditioner including a box-shaped housing having a top plate portion, a side plate portion and an opening portion at the lower portion thereof, a face panel detachably mounted on the opening portion of the housing, an indoor heat exchanger through which the inside of the housing is compartmented into a primary side and a secondary side, and an air blower secured to the top plate portion of the housing that faces the primary side, has a primary side heat insulating material is provided to the top plate portion so as to face the primary side of the housing and a secondary side heat insulating material provided to the side plate portion so as to face the secondary side of the housing, wherein the primary side heat insulating material is provided with an opening portion through which the air blower is fixed to the top plate portion.

5 Claims, 24 Drawing Sheets

(51) Int. Cl.

| | |
|---|---|
| ***F24F 1/00*** | (2011.01) |
| ***F24F 13/14*** | (2006.01) |
| ***F24F 13/20*** | (2006.01) |
| ***F24F 13/32*** | (2006.01) |
| *F24F 13/06* | (2006.01) |

(52) U.S. Cl.

CPC ..... *F24F 1/0018* (2013.01); *F24F 1/0022* (2013.01); *F24F 13/1426* (2013.01); *F24F 2001/0037* (2013.01); *F24F 2013/0616* (2013.01)

(56) References Cited

U.S. PATENT DOCUMENTS

| | | | | |
|---|---|---|---|---|
| 6,450,880 | B1 | 9/2002 | Asahina et al. | |
| 2002/0152760 | A1* | 10/2002 | Okuda et al. | 62/259.2 |
| 2005/0115261 | A1* | 6/2005 | Sakanoue et al. | 62/246 |
| 2008/0072613 | A1 | 3/2008 | Liu | |
| 2008/0159848 | A1 | 7/2008 | Liu | |

FOREIGN PATENT DOCUMENTS

| | | | | | |
|---|---|---|---|---|---|
| EP | 1327829 | | | 7/2003 | |
| EP | 1548375 | | | 6/2005 | |
| EP | 1795820 | | | 6/2007 | |
| EP | 1867930 | | | 12/2007 | |
| EP | 1873461 | | | 1/2008 | |
| JP | 7-324769 | A | | 12/1995 | |
| JP | 07324769 | | | 12/1995 | |
| JP | 07332697 | | | 12/1995 | |
| JP | 9-126539 | A | | 5/1997 | |
| JP | 10103759 | | | 4/1998 | |
| JP | 10-274432 | A | | 10/1998 | |
| JP | 11141912 | | | 5/1999 | |
| JP | 11351661 | | | 12/1999 | |
| JP | 2000-18635 | | * | 1/2000 | F24F 1/00 |
| JP | 2000-257905 | | * | 9/2000 | F24F 1/00 |
| JP | 2001-147042 | A | | 5/2001 | |
| JP | 2001-235174 | | | 8/2001 | |
| JP | 2001235174 | | | 8/2001 | |
| JP | 2001235177 | | | 8/2001 | |
| JP | 3284755 | | | 3/2002 | |
| JP | 2003-202151 | A | | 7/2003 | |
| JP | 2004-076960 | A | | 3/2004 | |
| JP | 2004-084999 | | | 3/2004 | |
| JP | 2004-92997 | A | | 3/2004 | |
| JP | 2004-92999 | A | | 3/2004 | |
| JP | 2004084999 | | | 3/2004 | |
| JP | 2005-249294 | A | | 9/2005 | |
| JP | 2006-266664 | A | | 10/2006 | |
| JP | 2007-093041 | | | 4/2007 | |
| JP | 2007093041 | | | 4/2007 | |

OTHER PUBLICATIONS

Japanese Office Action dated Oct. 11, 2011, issued in corresponding Japanese Patent Application No. 2007-203776.

Japanese Office Action dated Oct. 11, 2011, issued in corresponding Japanese Patent Application No. 2007-203822.

Japanese Office Action dated Oct. 18, 2011, issued in corresponding Japanese Patent Application No. 2007-192761.

Japanese Office Action dated Feb. 28, 2012, issued in corresponding Japanese Patent Application No. 2007-192762.

* cited by examiner

IN-CEILING MOUNT TYPE AIR CONDITIONER AND INDOOR UNIT THEREOF

INCORPORATION BY REFERENCE

The present application claims priority under 35 U.S.C. §119 to Japanese Patent Application No. 2007-192761 filed on Jul. 25, 2007, Japanese Patent Application No. 2007-192762 filed on Jul. 25, 2007, Japanese Patent Application No. 2007-203776 filed on Aug. 6, 2007, and Japanese Patent Application No. 2007-203822 filed on Aug. 6, 2007. The content of the applications is incorporated herein by reference in its entirety.

BACKGROUND OF THE INVENTION

1. Field of the Invention

The present invention relates to an in-ceiling mount type air conditioner.

2. Description of the Related Art

An indoor unit of an in-ceiling mount type air conditioner has a box-shaped housing having an opening portion at the lower side thereof. The inside of the housing is compartmented into a primary space and secondary space by an indoor heat exchanger. The primary space is partitioned by a top plate portion of the housing and the indoor heat exchanger, and indoor air which has not yet been air-conditioned is taken from a room into the primary space. The secondary space is partitioned by a side plate portion of the housing, the top plate portion and the indoor heat exchanger, and air-conditioned air is fed from the primary space into the secondary space. In order to prevent occurrence of condensation due to the air-conditioned air, a secondary side heat insulating material is provided to the side plate portion and the top plate portion of the housing facing the secondary primary space so as to cover the whole surface of the side and top plate portions (for example, see JP-A-2004-84999).

On the other hand, there is little risk that condensation occurs in the primary side space as compared with the secondary side space, however, condensation may occur when the humidity of air in the space under the roof is high. Therefore, there is a case where a heat insulating material is attached to the outside surface of the housing from the outside of the housing.

When the heat insulating material is attached the outside surface of the housing from the outside of the housing, the height dimension of the indoor unit is increased.

Furthermore, the indoor unit of the in-ceiling mount type air conditioner has an elongated air blow-out port extending along each side of a face panel, and a flap is provided at the inside of the air blow-out port to adjust the air blowing direction of air after heat-exchange. This flap extends over the longitudinal direction of the air blow-out port, and it is secured so as to be rotatable around swinging shafts formed at both the ends in the longitudinal direction. A regulating member for regulating the swing range of the flap is provided at the center portion of the flap. This regulating member is brought into contact with a regulating member provided to the main body side at the start time of the operation so that the start point of the swing range of the flap is set (for example, see JP-A-2007-93041).

However, the flap is designed in an elongated shape, and also it is a resin molded article, so that it may be warped (deformed) by heat of blown-out air or the like. When the flap is warped, the position of the regulating member of the flap is displaced, and the contact position between the regulating member of the flap and the regulating member of the main body side. Therefore, there is a risk that the start point of the swing range of the flap is displaced.

Still furthermore, there is known an in-ceiling mount type air conditioner having a housing in which an air blower and a heat exchanger are accommodated, and a face panel disposed at the lower side of the housing (for example, see JP-A-2001-235174). This type air conditioner has a temporal tacking portion for temporarily tacking the face panel to the housing for safety. The face panel is temporarily tacked to the temporal tacking portion, and then the face panel is fixed to the housing by screws.

In this case, for example, insert fittings are provided to the bottom surface of a drain pan, and the temporal tacking portions are provided to the insert fittings. Therefore, there are problems that the structure is complicated, the number of parts is increased and the manufacturing cost is increased.

Still furthermore, there is known an in-ceiling mount type air conditioner in which the main body of the air conditioner are suspended from the ceiling through suspending bolts, a face panel is secured to the lower surface of the main body of the air conditioner and corner panels are freely detachably provided to the four corners of the panel body of the face panel.

In this type of air conditioner, for example when a worker operates the suspending bolts to adjust the height of the main body of the indoor unit or the like, the worker detaches a corner panel from the panel body to expose an opening formed in the panel body, and inserts his/her hand or a machine tool through this opening or the like to access and operate the suspending bolt. Here, the corner panel is required to be easily removable from the panel body at the working time as described above from the viewpoint of quickness.

In view of this, there is provided an air conditioner in which a permanent magnet is provided to a corner panel, a metal plate is provided to the face panel in connection with this permanent magnet, and the easiness of detachment of the corner panel from the face panel is enhanced by utilizing the attraction force between the permanent magnet and the metal plate (for example, see Japanese Patent No. 3284755).

However, in the above air conditioner, the manufacturing cost is increased because the permanent magnet and the metal plate are required, and also it is also required to provide a special mechanism for securing the permanent magnet and the plate to the corner panel and the face panel, so that the part structure is complicated.

SUMMARY OF THE INVENTION

Therefore, an object of the present invention is to provide an indoor unit of an in-ceiling mount type air conditioner in which a heat insulating effect can be obtained without increasing the height dimension of the indoor unit.

Furthermore, another object of the present invention is to provide an indoor unit of an in-ceiling mount type air conditioner in which the displacement of a swing range of a flap can be reduced even when the flap warps.

Still furthermore, a further object of the present invention is to provide an in-ceiling mount type air conditioner having a simple structure for temporarily tacking a face panel, so that the number of parts can be reduced and thus the manufacturing cost can be reduced.

Still furthermore, a further object of the present invention is to provide an in-ceiling mount type air conditioner in which the cost can be reduced and the part structure can be simplified with keeping the easiness of the detachment of a corner panel from a face panel.

According to a first aspect of the present invention, in order to attain the above object, an indoor unit of an in-ceiling mount type air conditioner including a box-shaped housing having a top plate portion, a side plate portion and an opening portion at the lower portion thereof, a face panel detachably mounted on the opening portion of the housing, an indoor heat exchanger through which the inside of the housing is compartmented into a primary side and a secondary side, and an air blower secured to the top plate portion of the housing that faces the primary side, further comprises: a primary side heat insulating material provided to the top plate portion so as to face the primary side of the housing; and a secondary side heat insulating material provided to the side plate portion so as to face the secondary side of the housing, wherein the primary side heat insulating material is provided with an opening portion through which the air blower is fixed to the top plate portion.

According to this construction, the primary side heat insulating material can be provided to the top plate portion facing the primary side of the housing (i.e., the inner surface of the top plate portion) so as to avoid the fixing portion of the air blower.

In the above construction, the primary side heat insulating material and the secondary side heat insulating material may be formed integrally with each other. In this construction, the heat insulating material is integrally formed, and thus the number of parts can be reduced. Furthermore, the number of fixing steps can be also reduced.

Furthermore, in the above construction, the inner surface of the primary side heat insulating material which faces the air blower may be designed to be flat. In this construction, air stream fed by the air blower is not disturbed and the air flow can be rectified.

In the above construction, the inner surface of the primary side heat insulating material may be provided with a groove portion through which wires are passed and a wire fixing clasp for fixing the wires in the groove portion and fixing the primary side heat insulating material to the top plate portion of the housing. According to this construction, the wires can be surely fixed, and also the heat insulating material can be surely fixed to the top plate portion.

According to the first aspect of the present invention, the primary side heat insulating material is provided to the top plate portion which faces the primary side of the housing, and the opening portion for fixing the air blower to the top plate portion is formed in the primary side heat insulating material. Therefore, the primary side heat insulating material can be secured to the top plate portion while avoiding the fixing portion of the air blower. Accordingly, it is unnecessary to displace the fixing position of the air blower by the amount corresponding to the thickness of the primary side heat insulating material. Therefore, it is not required to increase the height dimension of the housing. Therefore, as compared with a case where a heat insulating material is provided to the outside of the top plate portion, the heat insulation effect can be obtained without increasing the overall height of the indoor unit.

Furthermore, the primary side heat insulating material and the secondary side heat insulating material are formed integrally with each other, and thus as compared with a case where they are separately secured, the securing time can be shortened, and also the securing work can be easily performed. Furthermore, the number of parts can be reduced, and thus the number of fabrication steps can be reduced.

Still furthermore, the inner surface of the primary side heat insulating material which faces the air blower is designed to be flat, so that no turbulence occurs even when air stream fed by the air blower impinges against the inner surface of the primary side heat insulating material. In addition, air stream fed from the air blower can be rectified, so that wind noise (air flowing noise) can be reduced and thus the noise insulation effect can be achieved.

Still furthermore, the groove portion through which the wires of the air blower are passed is formed on the inner surface of the primary side heat insulating material, and the wire fixing clasp for fixing the wires in the groove portion and fixing the primary heat insulating material to the top plate portion of the housing is provided, so that the wires of the air blower can be surely fixed. In addition, the heat insulating material can be surely fixed to the top plate portion, and thus no needless gap occurs between the heat insulating material and the top plate portion.

According to a second aspect of the present invention, an indoor unit of an in-ceiling mount type air conditioner including a box-shaped housing having a top plate portion, a side plate portion and an opening portion at the lower portion thereof, a face panel detachably mounted on the opening portion of the housing, an indoor heat exchanger through which the inside of the housing is compartmented into a primary side and a secondary side, and an air blower secured to the top plate portion of the housing that faces the primary side, further comprises: an air blow-out port formed in an elongated shape along a side of the face panel; a flap that extends in a longitudinal direction of the air blow-out port and has swinging shafts at both the end portions thereof; and a fixing seat having a fixing hole to which each of the swinging shafts of the flap is swingably secured and a stepping motor for driving the swinging shaft of the flap, wherein each of the swinging shafts of the flap is provided with a projecting portion that projects outward from the outer peripheral surface of the swinging shaft, and a hole wall portion of the fixing hole of the fixing seat is provided with at least one engaging groove portion that abuts against the projecting portion to regulate a swing range of the flap.

According to the above construction, the swing range of the flap can be regulated on the basis of the position of the fixing hole.

In the above construction, the hole wall portion of the fixing hole of the fixing seat may be provided with two engaging groove portions which are bilaterally symmetrical with each other. In this construction, it is unnecessary to provide plural kinds of fixing seats in accordance with the position of the engaging groove portion.

Furthermore, the fixing hole may be designed in a cylindrical shape. In this construction, the fixing hole and the engaging groove portion can be easily formed.

According to the second aspect of the present invention, the swinging shaft of the flap is provided with the projecting portion projecting outward from the outer peripheral surface of the swinging shaft, and the hole wall portion of the fixing hole is provided with the engaging groove portion for regulating the swing range of the flap by abutting against the projecting portion. Therefore, the swing range of the flap can be regulated by the fixing hole portion in the neighborhood of the fixing portion of the stepping motor. Therefore, even when the flap is warped due to the heat of blown-out air or the like, the effect of the heat does not affect the projecting portion, so that the displacement between the projecting portion and the engaging groove portion can be suppressed. As a result, heat-exchanged air can be fed to a desired area under air-conditioning operation.

Furthermore, the engaging grooves are symmetrically formed in the hole wall portion of the fixing hole. Therefore, even when the fixing orientation of the flap to the fixing seat is reversed, the projecting portion can be made to abut against the engaging groove portion. Therefore, it is unnecessary to provide plural kinds of fixing seats, and the parts can be made common by one fixing seat.

Still furthermore, by designing the fixing hole in a cylindrical shape, the fixing hole and the engaging groove portions can be easily formed, and thus the manufacturing cost can be reduced.

According to a third aspect of the present invention, an in-ceiling mount type air conditioner including a box-shaped housing having a top plate portion, a side plate portion and an opening portion at the lower portion thereof, a face panel detachably mounted on the opening portion of the housing, an indoor heat exchanger through which the inside of the housing is compartmented into a primary side and a secondary side, an air blower secured to the top plate portion of the housing that faces the primary side, and suspending fittings which are provided to the side plate portion of the housing through which suspending bolts hung from beams of a ceiling are inserted to suspend the housing from the ceiling, is characterized in that each of the suspending fittings comprises a first portion extending in the housing, a second portion extending through an opening formed in the housing to the outside of the housing substantially in parallel to the top plate portion, and a third portion that is hooked to the lower end edge of the side plate portion of the housing to support the lower end edge of the side plate portion and provided with a temporal tacking portion for temporarily tacking the face panel to the housing.

According to the third aspect of the present invention, the temporal tacking portion for temporarily tacking the face panel is provided to the third portion constituting a part of the suspending fitting, so that the structure of temporarily tacking the face panel is simplified and it is unnecessary to separately provide the temporal tacking portion. Therefore, the number of parts can be reduced, and further the manufacturing cost can be reduced.

In the above construction, the third portion may be provided with an actually fixing portion for actually fixing the temporarily tacked face panel to the housing. According to this construction, the actually fixing portion and the temporal tacking portion are provided to the third portion of the suspending fitting, and thus the structure of fixing the face panel can be simplified. Furthermore, both the actually fixing portion and the temporal tacking portion are provided to the third portion of the suspending fitting. Therefore, after the face panel is temporarily tacked, the face panel can be directly actually fixed to the housing without changing the position of a stepladder on which the worker rides, for example, so that the workability can be enhanced.

Furthermore, the temporal tacking portion may be formed by bending the tip portion of the third portion upwardly. According to this construction, the temporal tacking portion can be simply formed, and the structure of temporarily tacking the face panel can be simplified.

In the above construction, the face panel may be provided with opening portions at four corners thereof that correspond to the suspending fittings, the opening portions of the face panel being covered by corner panels, and each of a pair of diagonally-located opening portions out of the opening portions of the face panel may be provided with a hook member which is hooked to the temporal tacking portion. According to this construction, by detaching the corner panel, the hook member can be easily accessed, and thus the hook member and the temporal tacking portion can be easily hooked/unhooked. Furthermore, the hook member is provided at each of the diagonally-located opening portions of the face panel, and thus in the case of a mini-cassette type indoor unit having a small outer-shape width, a worker can be easily attach/detach the face panel alone.

According to the third aspect of the present invention, the third portion constituting a part of the suspending fitting is provided with the temporal tacking portion for temporarily tacking the face panel, so that the structure of temporarily tacking the face panel is simplified and thus it is unnecessary to separately provide the temporal tacking portion. Accordingly, the number of parts can be reduced, and the manufacturing cost can be reduced.

According to a fourth aspect of the present invention, an in-ceiling mount type air conditioner including a box-shaped housing having a top plate portion, a side plate portion and an opening portion at the lower portion thereof, a face panel detachably mounted on the opening portion of the housing, an indoor heat exchanger through which the inside of the housing is compartmented into a primary side and a secondary side, an air blower secured to the top plate portion of the housing that faces the primary side and a corner panel which is detachably mounted at each of four corners of a panel body of the face panel, is characterized in that the corner panel is provided with an engaging pawl to be engageable with an engaging hole formed at each of the four corners of the panel body of the face panel, and a joint leg that is formed at one corner portion of the corner panel so as to extend to a seat portion provided to a corner inner wall portion of the panel body and be fixed to the seat portion when the corner panel is mounted on the panel body of the face panel.

In the above construction, the joint leg may be formed of elastic material, and provided with a projecting portion to be engageable with an engaging hole formed in the corner inner wall portion.

In the above construction, a tab portion may be formed at the tip of the joint leg so as to extend over the seat portion when the corner panel is mounted on the panel body of the face panel.

According to the fourth aspect of the present invention, the corner panel is pressed to the ceiling-side direction at the position of the panel body where the corner panel should be secured, the engaging pawl of the corner panel is engaged with the engaging hole formed in the panel body, and the projecting portion of the joint leg of the corner panel is fitted in the engaging hole of the corner inner wall portion of the panel body, whereby the corner panel can be easily secured to the panel body. Furthermore, by elastically deforming the joint leg to release the engagement between the projecting portion and the engaging hole, the corner panel can be easily detached from the panel body. Therefore, the easiness of the attachment/detachment can be secured without using any special member such as permanent magnet, a plate or the like, the cost can be reduced and the member structure can be simplified.

DETAILED DESCRIPTION OF THE PREFERRED EMBODIMENTS

Preferred embodiments according to the present invention will be described hereunder with reference to the accompanying drawings.

First Embodiment

Figure 1:
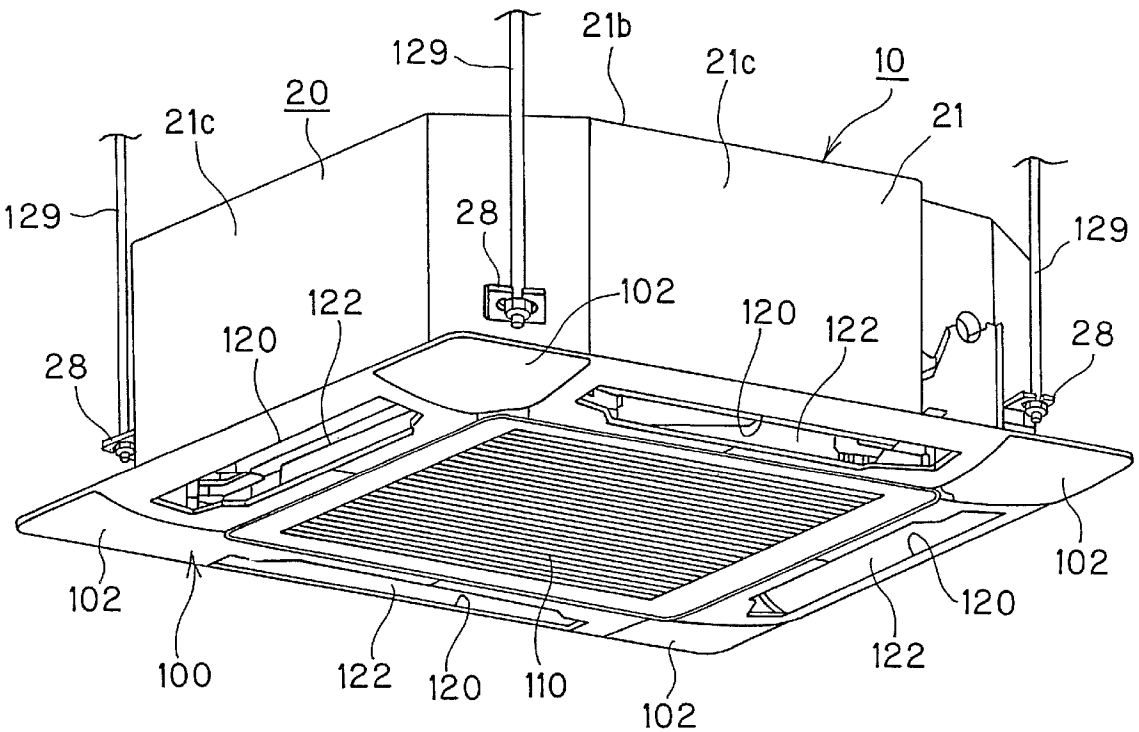
FIG. 1 is a diagram showing an indoor unit of an in-ceiling mount type air conditioner according to the present invention when viewed from the lower slant side.
Figure 2:
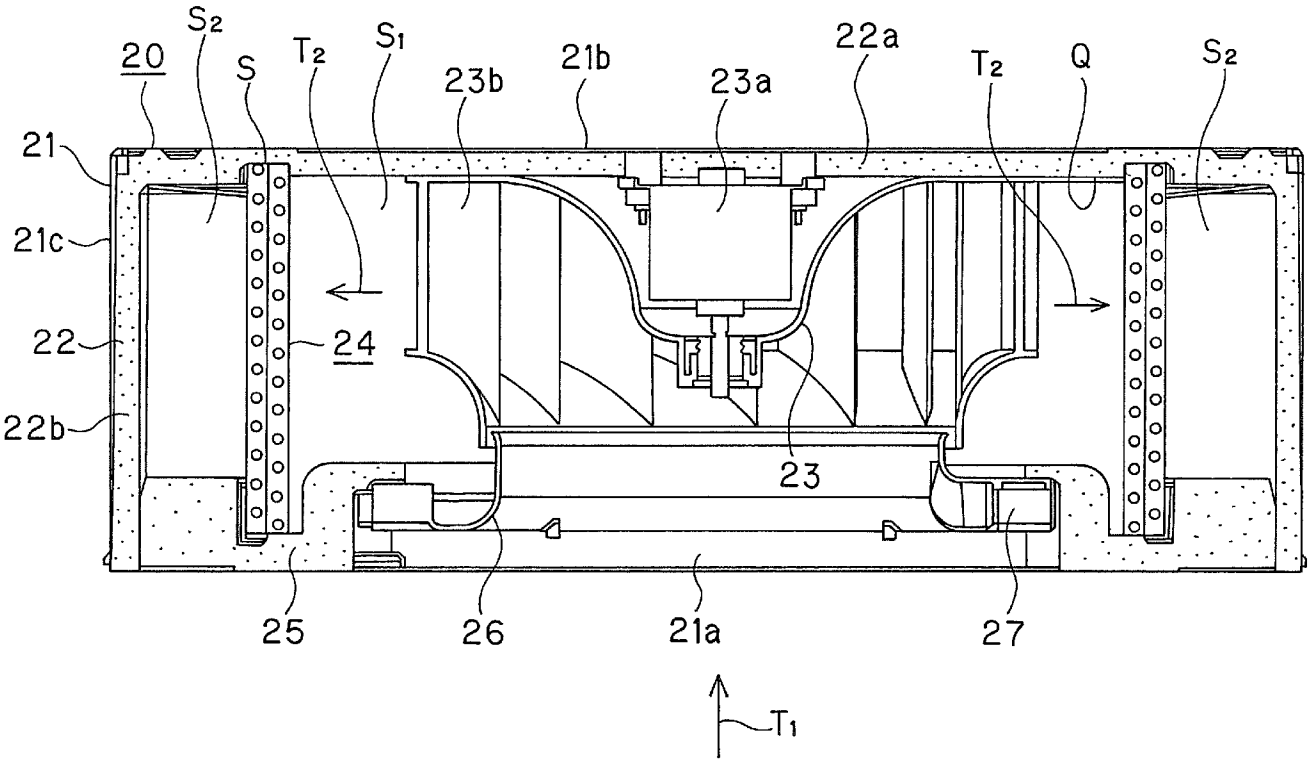
FIG. 2 is a cross-sectional view of the side portion of an indoor unit shown in FIG. 1.

A first embodiment according to the present invention will be described hereunder with reference to the accompanying drawings. FIG. 1 is a perspective view showing an indoor unit 10 of an in-ceiling mount type air conditioner which is viewed from the lower surface side, and FIG. 2 is a longitudinally-sectional view of an indoor unit main body 20. In this embodiment, a four-way cassette type and mini cassette type indoor unit of 600 mm×600 mm in outer shape will be described as an example of the indoor unit 10. However, the present invention is not limited to the above type, and it may be applicable to an two-way type indoor unit or a four-way type indoor unit having a general outer shape.

As shown in FIG. 1, the indoor unit 10 of the air conditioner has an indoor unit main body 20 which is inserted into a fixing opening portion provided to a ceiling plate from the room side, and a face panel 100 secured to the indoor unit main body 20 from the lower side.

The indoor unit main body 20 has a housing 21 constituting the outer shape portion of the indoor unit main body 20. The housing 21 is designed in a box-shape, and it comprises a lower opening portion 21*a* whose lower side surface is fully opened, and a top plate portion 21*b* and a side plate portion 21*c*. The top plate portion 21*b* and the side plate portion 21*c* are fabricated by sheet metal processing. The lower opening portion 21*a* is closed by the face panel 100 described above.

Suspending fittings 28 for suspending the indoor unit main body 20 are provided at four corner portions on the outer surfaces of the side plate portions 21*c* of the housing 21 as shown in FIG. 1. The suspending fittings 28 are secured to suspending bolts 129 hung from the ceiling so that the indoor unit main body 20 is suspended from the ceiling. Furthermore, the indoor unit main body 20 may be fixed to holding bars which are provided in a grid form on the ceiling surface.

The face panel 100 has a suction port 110 for taking indoor air into the center portion of the face panel 100, four air blow-out ports 120 which are formed in an elongated shape along the sides of the face panel 100 around the air suction port 110 and blow out heat-exchanged air, and corner panels 102 constituting the four corner portions of the face panel 100. A flap 122 for adjusting the air blow-out direction is provided to each of the air blow-out ports 120. The corner panels 102 are constructed so as to be detachable to the lower side of the face panel 100, and has such a size that the hand of a fixing worker can reach the engagement position between the suspending fitting 28 and the suspending bolt 129 when the corner panel 102 is detached.

A heat insulating material 22 formed of foam polystyrene material (described in detail later) is installed on the whole inner surface of the top plate portion 21*b* and the side plate portion 21*c* of the housing 21, and the indoor unit main body 20 has such a heat insulating structure that heat transfer is little between the inside of the housing and the outside of the housing.

An indoor heat exchanger 24 which is formed in a substantially rectangular frame shape in plan view is mounted in the housing 21. The upper end portion of the indoor heat exchanger 24 is secured so that no gap occurs between the upper end portion and the heat insulating material 22 as shown in FIG. 2. The lower end portion of the heat exchanger 24 is secured so that no gap occurs between the lower end portion and a drain pan 25 for receiving drain water which is generated through a heat-exchanging operation. Accordingly, the inside of the indoor heat exchanger 24 is compartmented into a primary space S1 (the center portion of the housing 21 in plan view) and a secondary space S2 (the peripheral portion of the side plate portion of the housing 21 in plan view).

The primary space S1 is partitioned by the top plate portion 21*b* of the housing 21 and the indoor heat exchanger 24, and an air blower 23 is provided in this space. The air blower 23 comprises a fan motor 23*a* fixed to the top plate portion 21*b* of the housing 21 by proper means, and a fan 23*b* fixed to the swinging shaft of the fan motor. Accordingly, in connection with the rotation of the fan 23*b*, air is sucked toward the swinging shaft (in the T1 direction in FIG. 2) through the air suction port 110 and blown out to the peripheral portion (the direction to the indoor heat exchanger 24, in the T2 direction of FIG. 2).

Furthermore, a bell mouth 26 which is formed so as to be tapered to the air blower 23 is provided between the air suction port 110 of the face panel 100 and the air blower 23. An electrical part box 27 is provided to a part of the outer peripheral surface side of the bell mouth 26. A control circuit for controlling electrical parts such as the air blower 23, etc. is accommodated in the electrical part box 27.

The secondary space S2 is partitioned by the side plate portion 21*c* and the top plate portion 21*b* of the housing 21 and the indoor heat exchanger 24, and air blown from the primary space S1 is heat-exchanged by the indoor heat exchanger 24 and then fed into this secondary space S2.

Figure 3:
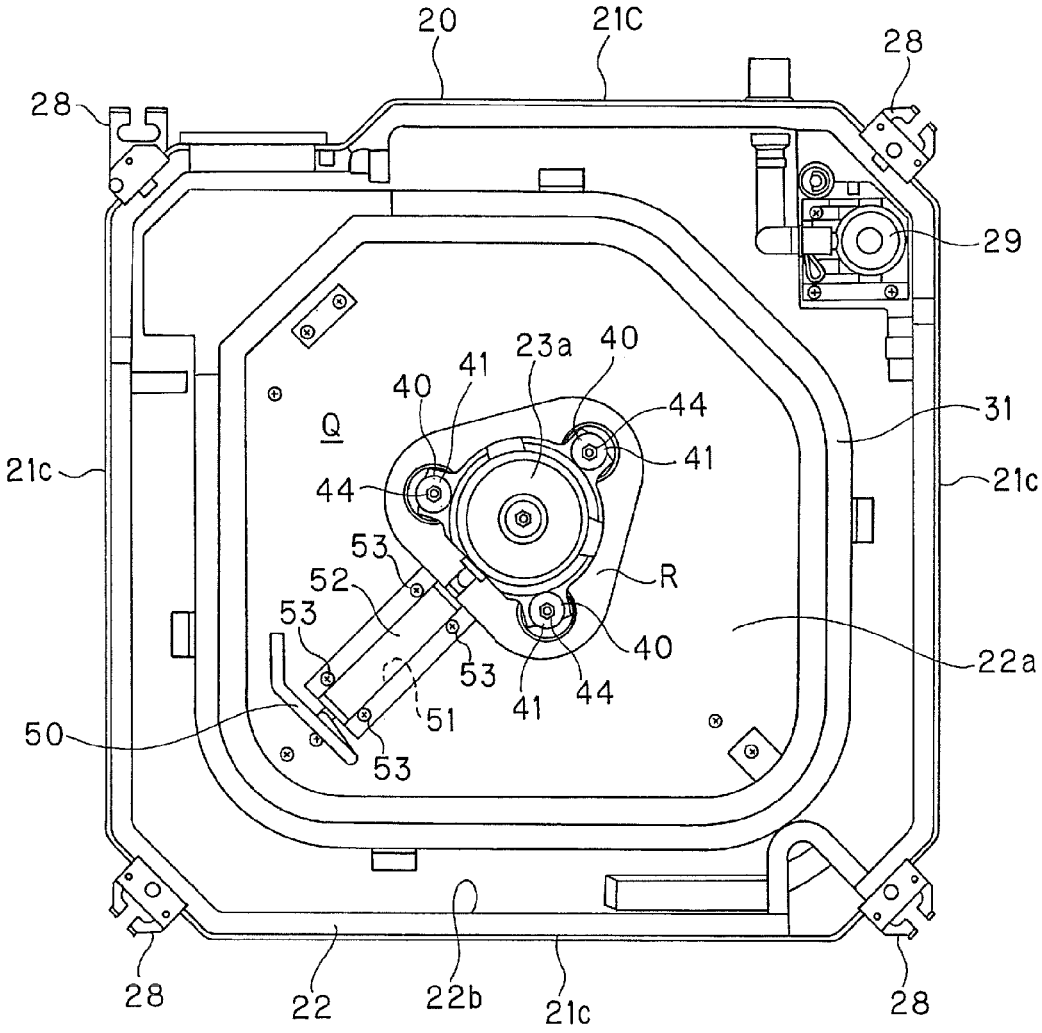
FIG. 3 is a plan view showing a state that a heat insulating material and a fan motor are fixed in a housing.
Figure 4:
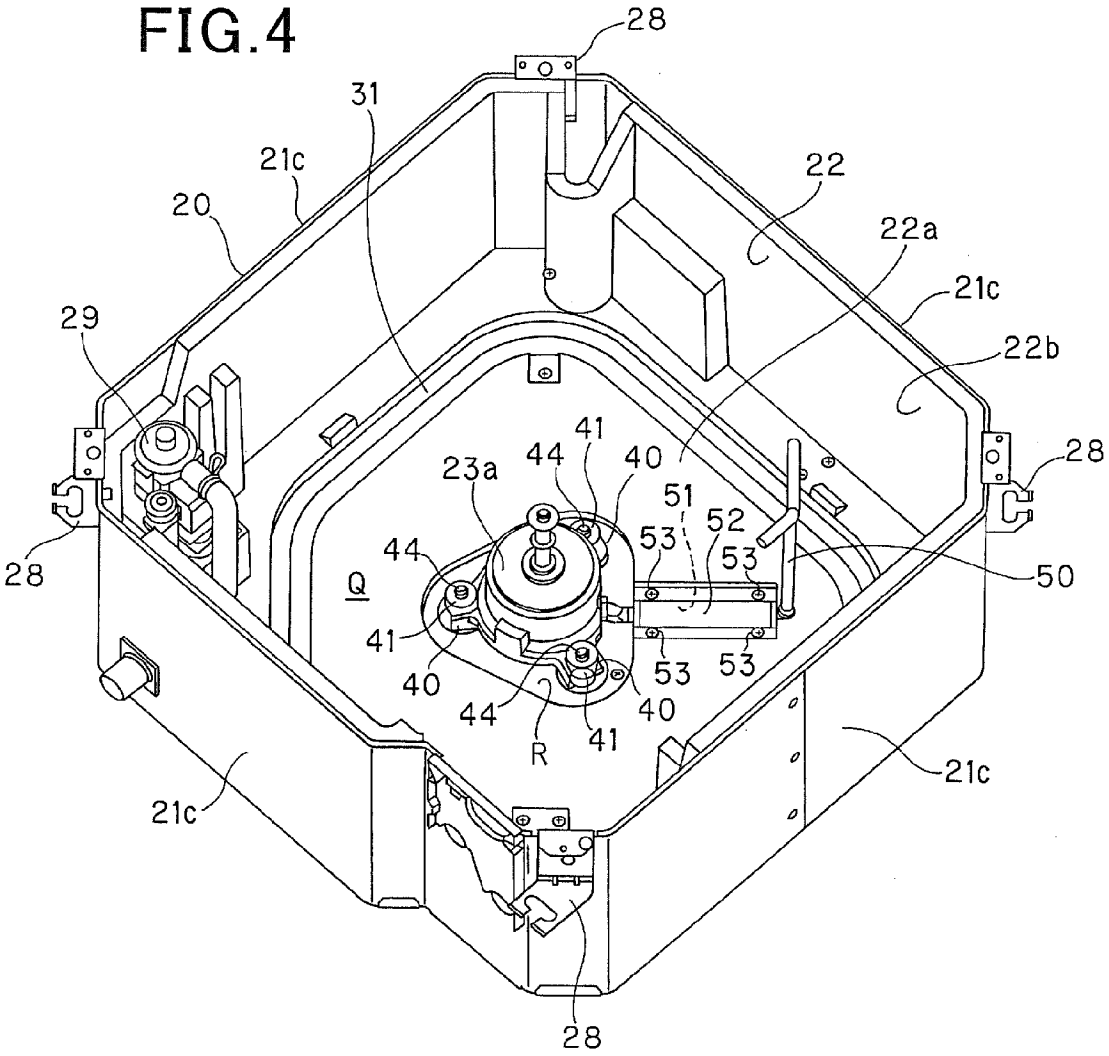
FIG. 4 is a perspective view of FIG. 3 when viewed from the slant upper side.
Figure 5:
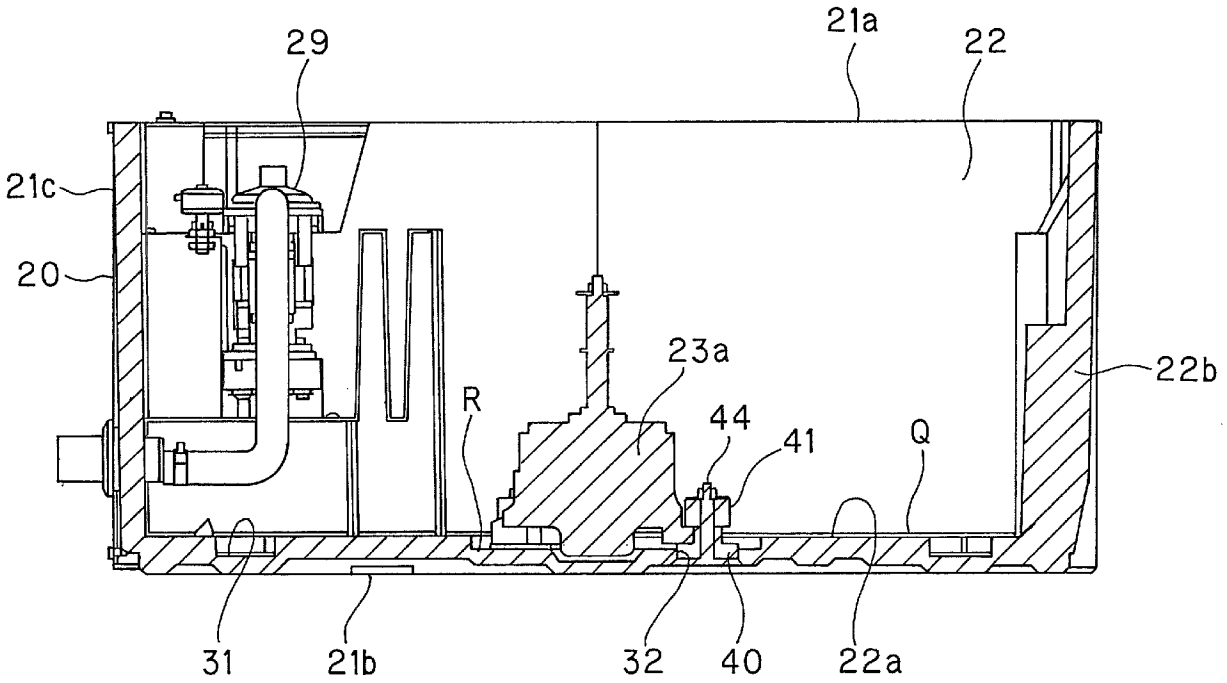
FIG. 5 is a cross-sectional view of the side portion of FIG. 3.
Figure 6:
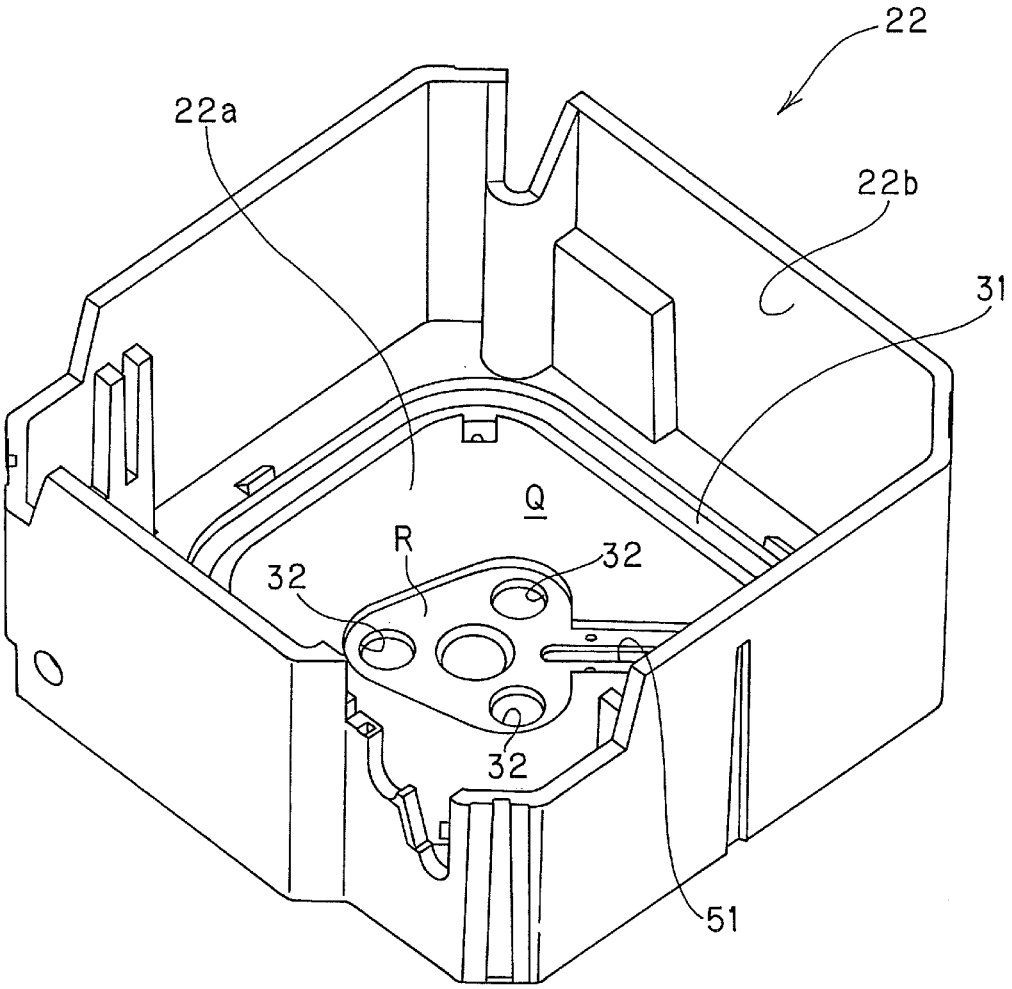
FIG. 6 is a perspective view when the heat insulating material as a single body is viewed from the slant upper side.

FIG. 3 is a bottom view showing the state that the heat insulating material 22, the fn motor 23*a* of the air blower 23 and the drain pump unit 29 for pumping drain water in the drain pan 25 are mounted in the housing 21. FIG. 4 is a perspective view obtained by viewing FIG. 3 from the slant upper side, and FIG. 5 is a cross-sectional view of the side portion of FIG. 3. FIG. 6 is a perspective view obtained by viewing the heat insulating material 22 as a single body from the slant upper side. FIGS. 3 to 6 show the state that the indoor unit main body 20 is disposed upside down (the lower opening portion 21*a* is placed face up), and the indoor unit main body 20 is fabricated under this state.

As shown in FIGS. 2 and 6, the heat insulating material 22 is constructed by a primary heat insulating material 22*a* facing the primary space S1, and a secondary heat insulating material 22*b* secured so a to face the secondary space. The primary heat insulating material 22*a* and the secondary heat insulating material 22*b* are integrally formed of foam polystyrene. The primary heat insulating material 22 serves to insulate heat between air above the top plate portion 21*b* under the roof and indoor air taken into the primary side. Furthermore, the secondary heat insulating material 22*b* serves to insulate heat between the air under the roof and air heat-exchanged by the indoor heat exchanger 24.

A groove portion 31 is formed on the inner surface Q of the primary heat insulating material 22*a* so as to surround the periphery of the fan motor 23*a* as shown in FIGS. 3 to 6. The indoor heat exchanger 24 is fabricated so that the upper end portion thereof is fitted to the bottom surface of the groove portion 31, and the upper end portion of the indoor heat exchanger 24 and the groove portion 31 are brought into contact with each other with no gap therebetween.

As shown in FIG. 6, a step face R to which the fan motor 23*a* is secured is formed in the inner surface Q of the primary heat insulating material 22*a*. This step face R is lower than the other portion of the inner surface Q by the distance corresponding to one step, and it is provided so that the fan motor 23*a* is located at the same height as the conventional air conditioner. As shown in FIG. 6, three opening portions 32 are formed in conformity with the positions of fixing portions 40 of the fan motor 23*a*. The opening portions 32 are formed so as to penetrate from the inner surface Q to the back side surface.

Figure 7:
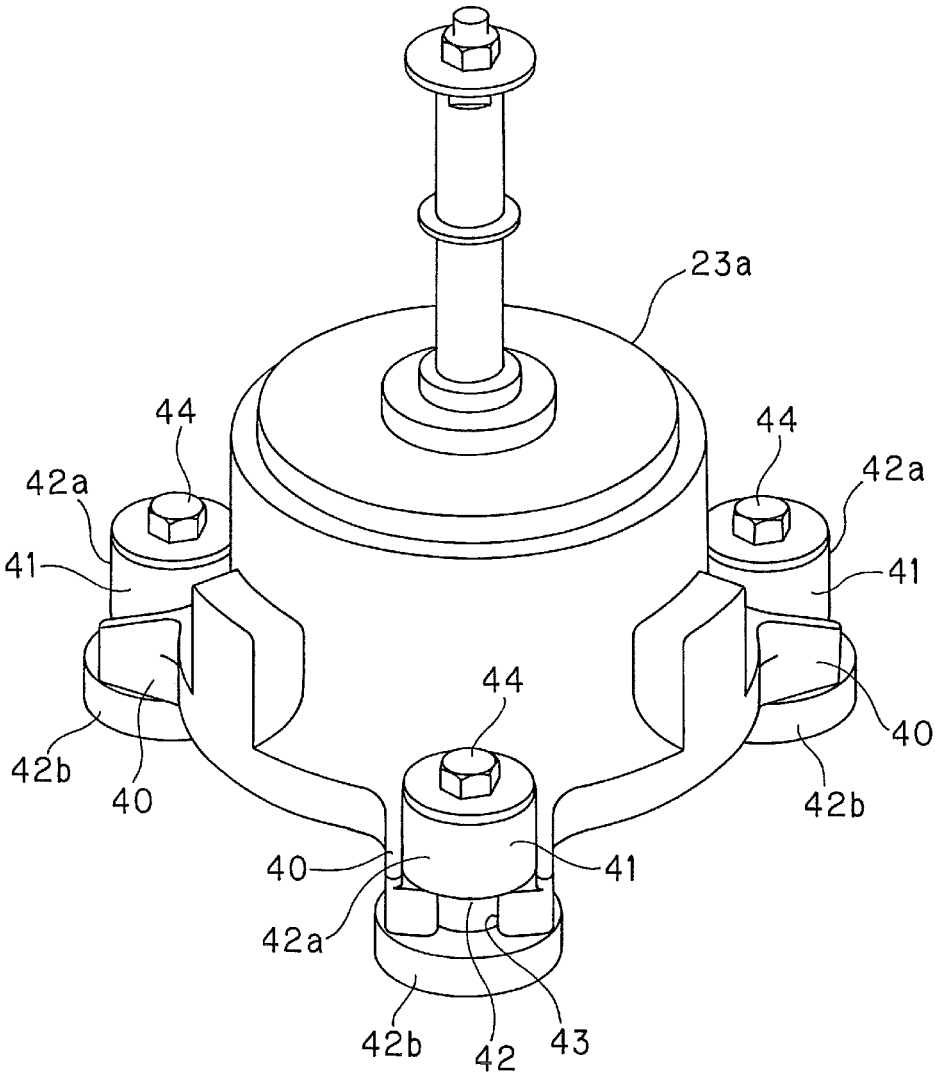
FIG. 7 is a perspective view showing a fan motor as a single body.
Figure 8:
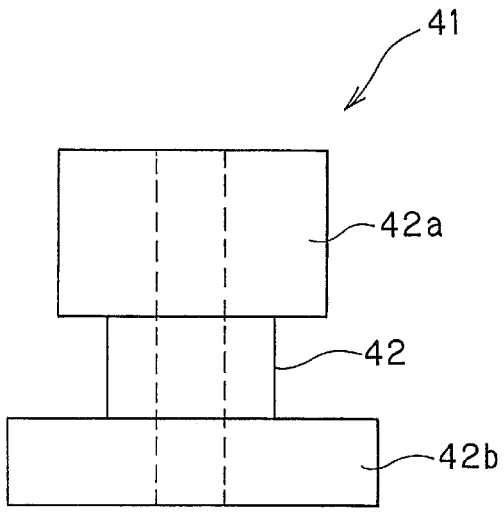
FIG. 8 is a side view of a rubber cushion secured to the foot portion of the fan motor.

As shown in FIG. 7, the fan motor 23*a* disposed at the step portion R has the three fixing portions 40, and a rubber cushion 41 is secured to each of the fixing portions 40. In more detail, the rubber cushion 41 is designed in a substantially cylindrical shape, and a constriction portion 42 is formed at the center portion of the rubber cushion 41 in the height direction as shown in FIG. 8. This constriction portion 42 is secured to a cut-out portion 43 formed in the fixing portion 40 so that the thick portion of the fixing portion 40 is pinched as shown in FIG. 7. Furthermore, the rubber cushion 41 is formed so that the upper side portion 42*a* and the lower side portion 42*b* are different in diameter through the constriction portion 42.

The diameter of the lower portion 42*b* is set to be substantially equal to the diameter of the opening portion 32 of the primary heat insulating material 22*a*, and the thus the lower portion 42*b* is fitted in the opening portion 32 with no gap. By fastening the fan motor 32*a* and the top plate portion 21*b* through bolts 44, the fan motor 23*a* is fixed to the top plate portion 21*b*. The rubber cushion 41 is provided to absorb vibration of the fan motor 23*a* when the fan motor 23*a* rotates.

As shown in FIG. 6, a groove portion 51 in which wires 50 extending from the fan motor 23*a* are accommodated is formed on the inner surface Q of the primary heat insulating material 22*a*. The wires 50 are connected to the electrical part box 27 and supply power to the fan motor 23*a*. A wire fixing clasp 52 is secured to the groove portion 51 so as to cover the groove portion 51. As shown in FIG. 3, the wire fixing clasp 52 is fixed to the top plate portion 21*b* by screws 53 or the like. The wire fixing clasp 52 is secured to the top plate portion 21*b*, whereby it has the function of pressing the primary heat insulating material 22*a* against the top plate portion 21*b* with no gap therebetween.

The inner surface Q of the primary heat insulating material 22*a* is formed by a flat surface having no step. Under the state that the wire fixing clasp 52 is fixed, the surface of the wire fixing clasp 52 and the inner surface Q are set on substantially the same plane.

That is, the inner surface Q is disposed so as to face the air blower 23, and air blown from the air blower 23 impinges against the inner surface Q. Therefore, it is prevented that air impinges against a step or an uneven portion and thus turbulence flow of air occurs. Furthermore, air impinges against the inner surface Q, and thus the flat surface serves to positively rectify air flow.

Accordingly to the indoor unit 10 of the in-ceiling mount type air conditioner according to this embodiment, the primary heat insulating material 22*a* is provided to the top plate portion 21*b* facing the primary space S1 of the housing 21, and thus heat insulation is performed between the air under the roof and the indoor air sucked into the primary space S1. Accordingly, occurrence of condensation in the housing 21 can be prevented.

The opening portion 32 for fixing the air blower 23 to the top plate portion 21*b* is formed in the heat insulating material 22*a*, and thus the primary heat insulating material 22*a* can be secured to the top plate portion with avoiding the rubber cushion 41 secured to the fixing portion 40 of the air blower 23. Therefore, the fixing position of the air blower 23 is not required to be displaced in the height direction by the amount corresponding to the provision of the primary heat insulating material 22*a*, so that it is not required to increase the height dimension of the housing 21. Therefore, as compared with the case where the heat insulating materials is provided at the outside of the top plate portion 21*b*, the heat insulation effect can be obtained without increasing the height of the indoor unit main body 20.

The primary heat insulating material 22*a* and the secondary heat insulating material 22*b* are formed integrally with each other, and as compared with the case where the primary heat insulating material 22*a* and the secondary heat insulating material 22*b* which are separately formed are fixed separately from each other, the fixing time can be shortened. In addition, the fixing work can be easily performed. Furthermore, the number of parts can be reduced, and thus the number of fabrication steps can be reduced.

Furthermore, the inner surface Q of the primary heat insulating material 22*a* which faces the air blower 23 is formed in a flat shape, so that air blown from the air blower 23 impinges against the inner surface Q of the primary heat insulating material 22*a* and thus no turbulence flow of air occurs. Furthermore, air blown from the air blower 23 can be rectified, so that air sound can be reduced and a noise insulating effect can be obtained.

The groove portion 51 through which the wires 50 of the air blower 23 are passed is formed on the inner surface of the primary heat insulating material 22*a*, and the wires 50 are fixed in the groove portion 51. In addition, the wire fixing clasp 52 for fixing the primary heat insulating material 22*a* to the top plate portion 21*b* of the housing 21 is provided, whereby the wires 50 of the air blower 23 can be surely fixed. Furthermore, the primary heat insulating material 22*a* can be surely fixed to the top plate portion 21*b*, and thus no needless gap occurs between the primary heat insulating material 22*a* and the top plate portion 21*b*.

The present invention is not limited to the above embodiments, and various kinds of modifications and alterations can be performed on the basis of the technical idea of the present invention.

In the indoor unit 10 of this embodiment, with respect to the heat insulating material 22, the primary heat insulating material 22*a* and the secondary heat insulating material 22*b* are formed integrally with each other. However, they may be formed separately from each other. That is, the heat insulating material may be formed by properly selecting one of the integration type and the separation type in consideration of the size of the metal mold of the heat insulating material, the cost of the metal mold, etc. although the size of the heat insulating material 22 is varied in accordance with the size of the indoor unit 10 (for example, a mini cassette type which is miniaturized in the outer dimension of 600 mm×600 mm).

Second Embodiment

Figure 9:
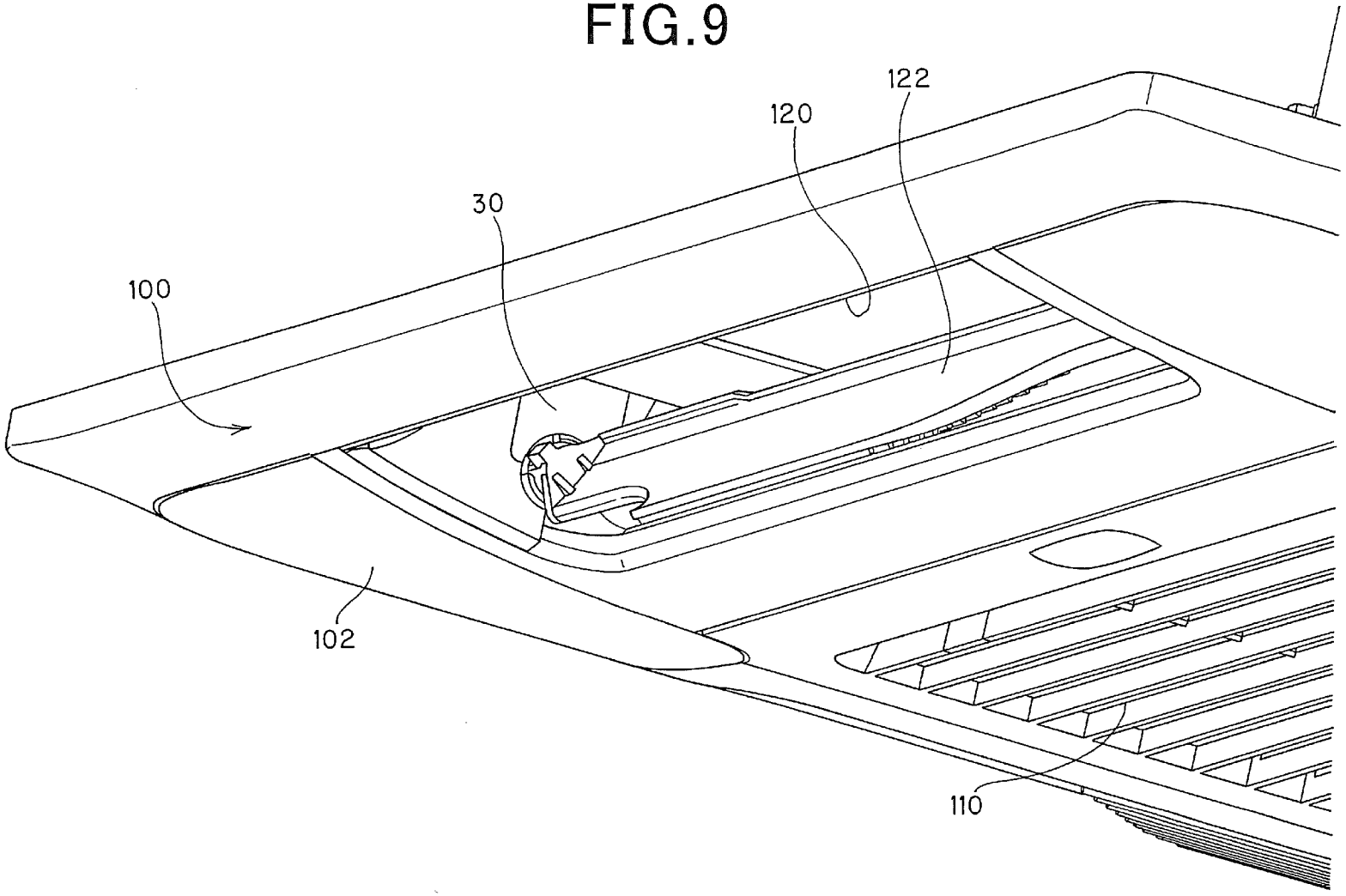
FIG. 9 is an enlarged perspective view of an air blow-out port formed in a face panel and a flap in the in-ceiling mount type air conditioner.
Figure 10:
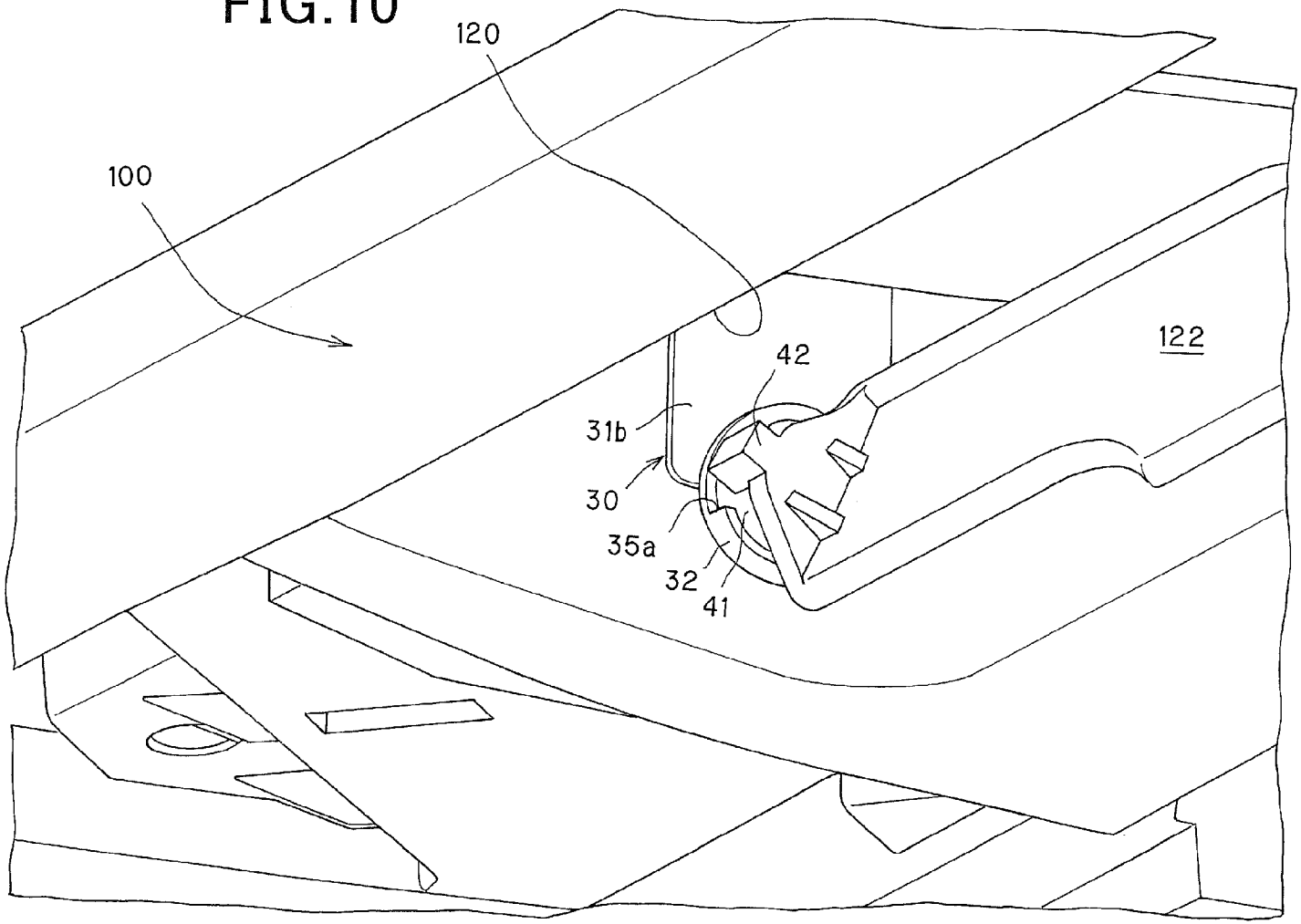
FIG. 10 is an enlarged diagram of a support portion of the flap of FIG. 9.
Figure 11:
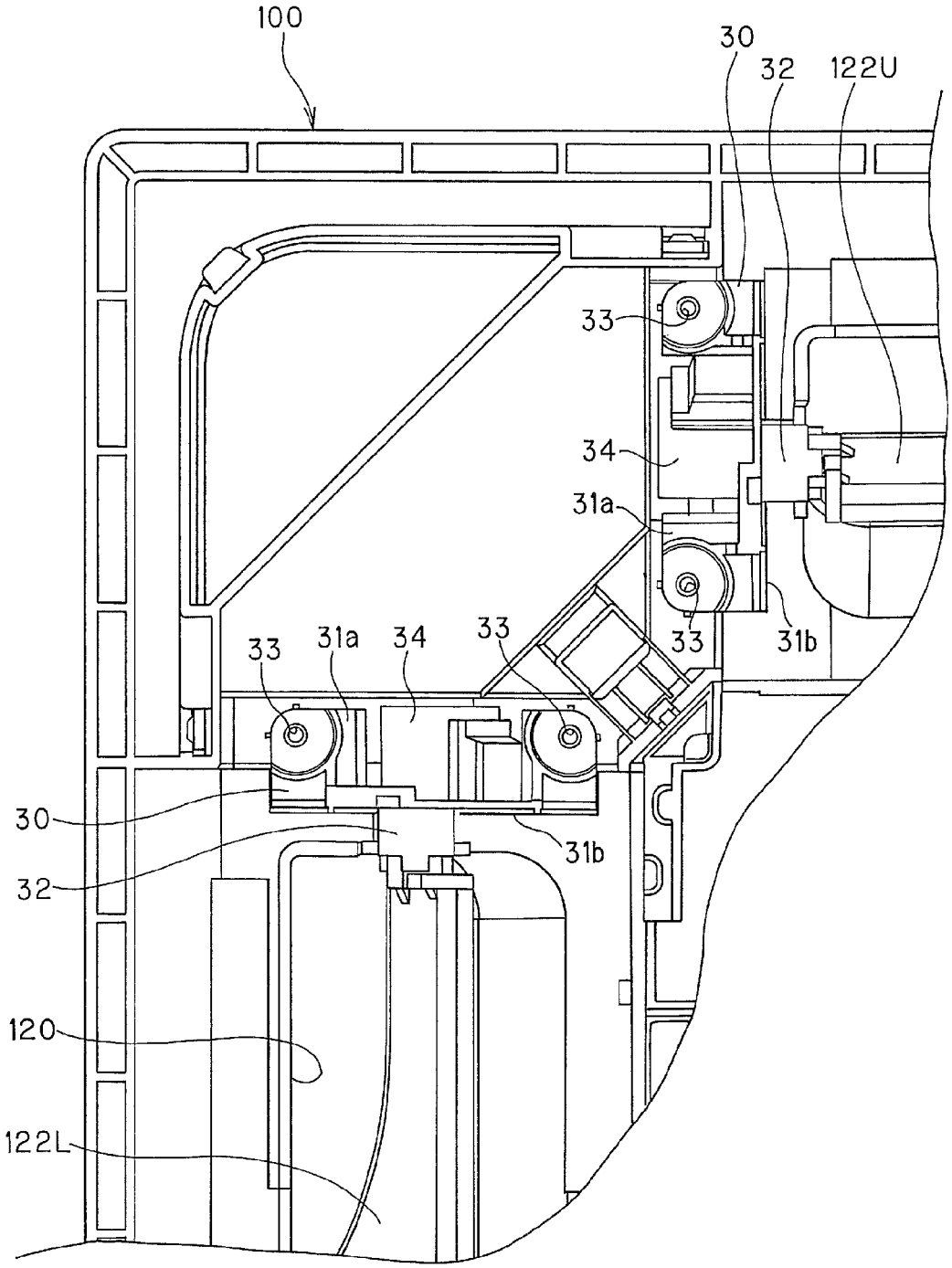
FIG. 11 is a plan view showing the fixing state of a stepping motor to the fixing seat.
Figure 12:
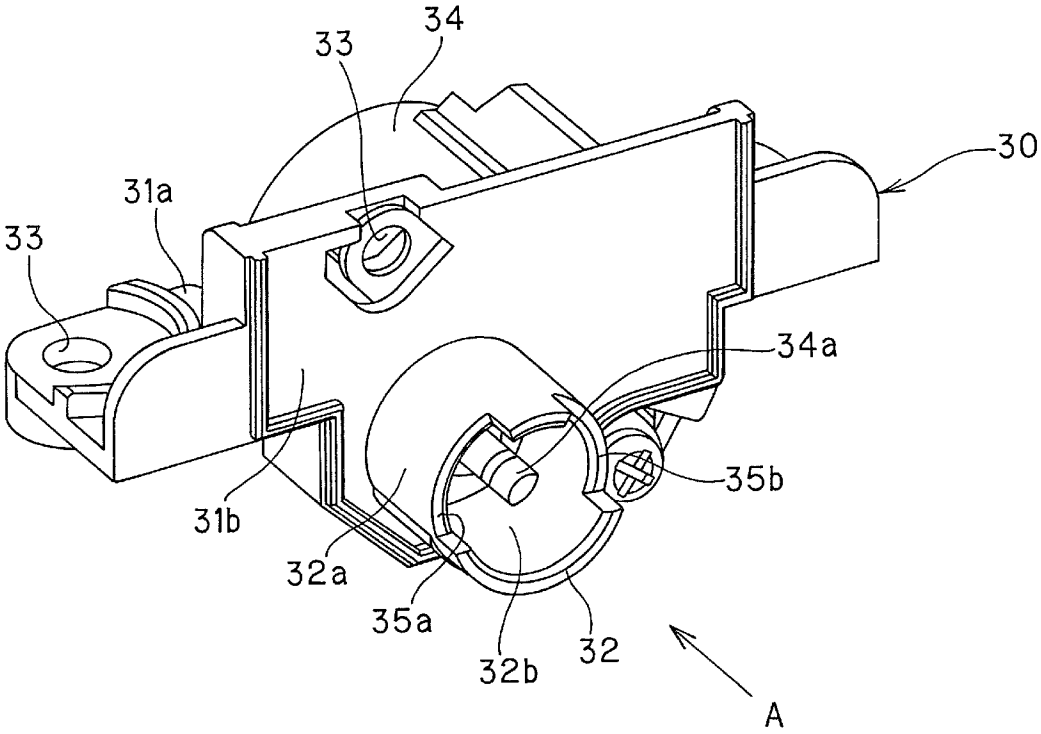
FIG. 12 is a perspective view showing the fixing seat for the stepping motor.
Figure 13:
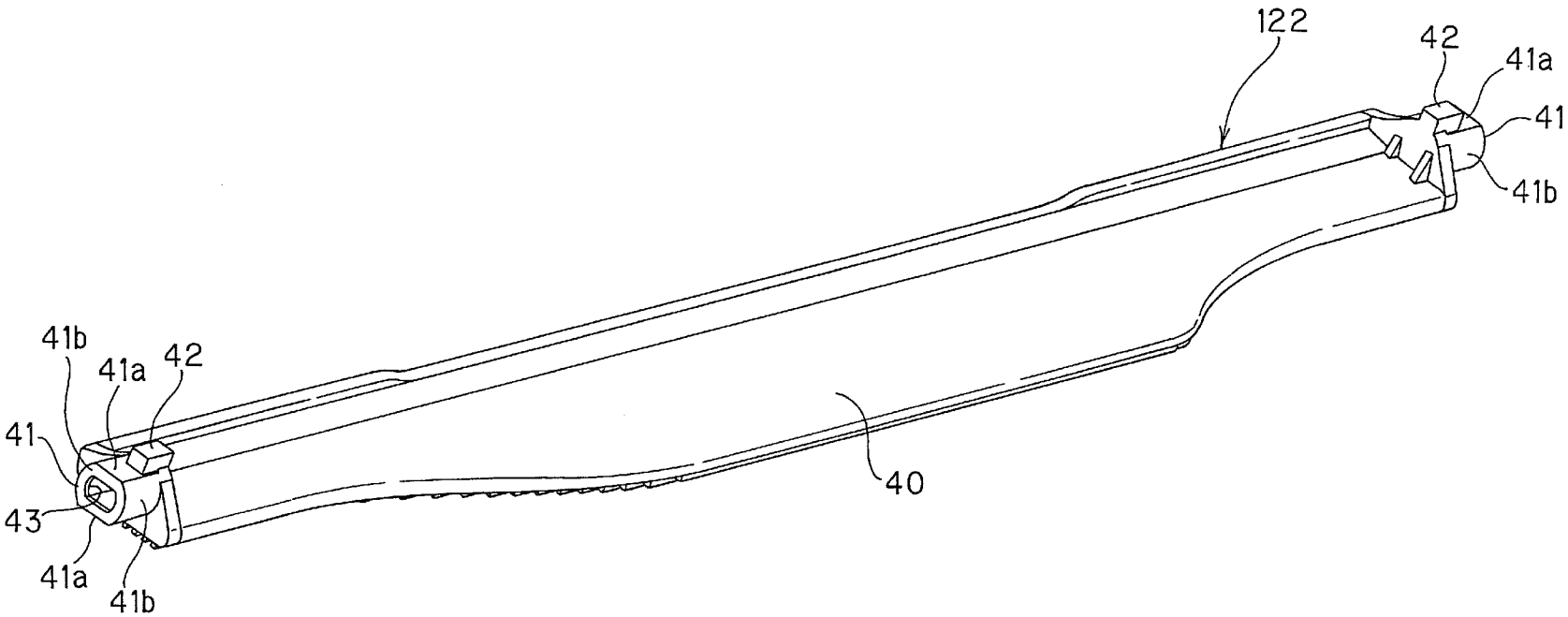
FIG. 13 is a perspective view showing the flap as a single body.

FIG. 9 is an enlarged perspective view showing the air blow-out port 1209 and the flap 122 formed in the face panel 100, and FIG. 10 is an enlarged view of the support portion of the flap. FIG. 11 is a planar view showing a state that the corner panel 102 is detached and a fixing seat for a stepping motor is secured to the face panel 100. FIG. 12 is a perspective view showing the fixing seat 30 for the stepping motor, and FIG. 13 is a perspective view showing the flap 122 as a single body.

The flap 122 extends substantially over the entire length in the longitudinal direction of the air blow-out port 120 as shown in FIGS. 1 and 9. Two fixing seats 30 for supporting one end in the longitudinal direction of the flap 122 is provided at one corner portion at the upper left side of FIG. 5 out of the four corner portions of the face panel 100 (that is, no fixing seat 30 is provided at the other three corner portions). One end of the flap 122 is supported by the fixing seat 30 as shown in FIG. 10.

As shown in FIG. 12, the fixing seat 30 is designed to be substantially L-shaped in section and comprises a horizontal plane portion 31*a* and an erecting wall portion 31*b*, and an L-shaped cylindrical support portion 32 projecting outward is formed on the outer surface of the erecting wall portion 31*b*. A fixing hole 33 for fixing the fixing seat 30 to the main body of the face panel 100 is provided in the horizontal plane portion 31*a*. As shown in FIG. 10, the outer surface of the erecting wall portion 31*b* constitutes the inner surface of the longitudinal-direction end portion of the air blow-out port 120.

Furthermore, the stepping motor 34 is fixed to the L-shaped inner portion of the fixing seat 30. The stepping motor 34 is connected to the electrical part box 27 by a wiring material (not shown), and the rotational angle thereof is controlled by the controller in the electrical part box 27.

The cylindrical support portion 32 has a hole wall portion 32*a* continuous in the peripheral direction, and a hollow portion 32*b* surrounded by the hole wall portion 32*a*. At least one engaging groove portion is formed in the hole wall portion 32*a*. In this embodiment, two engaging groove portions 35*a*, 35*b* which are bilaterally symmetrical with each other when the fixing seat 30 is viewed from the front side (viewed in the direction A of FIG. 12) are formed in the hole wall portion 32*a*. As shown in FIG. 12, the engaging groove portions 35*a*, 35*b* are designed to be cut out from the tip of the hole wall portion 32*a* to the erecting wall portion 31*b*.

As shown in FIG. 12, the driving shaft 34*a* of the stepping motor 34 is provided so as to project in the same direction as the projecting direction of the cylindrical support portion 32 at the center of the hollow portion 32*b* of the cylindrical support portion 32.

The flap 12 is integrally molded with resin material, and it comprises a wind direction plate 40 which extends in the longitudinal direction and increases in width at the center portion thereof, and two swinging shafts 41 which project outward from the end portions in the longitudinal direction of the wind direction plate 40 as shown in FIG. 11. The swinging shaft 41 is designed to have a substantially cylindrical shape, and flat portions 41*a* which are parallel to each other are formed at the upper and lower portions of the swinging shaft 41. A substantially rectangular parallelepiped projecting portion 42 is formed on the upper flat portion 41*a* so as to project outward from the outer periphery of the swinging shaft 41. Substantially elliptical engaging holes 43 which are coincident with the center axes of the swinging shafts 41 are formed at the respective shaft end portions of the swinging shafts 41. The diameter of the arcuate portion 41*b* of the swinging shaft 41 is set to be equal to or slightly smaller than the diameter of the hollow portion 32*b* of the cylindrical member 32.

When the swinging shaft 41 is inserted into the hollow portion 32*b* of the cylindrical support portion 32 shown in FIG. 12, the driving shaft 34*a* of the stepping motor 34 is inserted into the engaging hole 43. The arcuate portion 41*b* of the swinging shaft 41 is freely rotatable while coming into sliding contact with the inner wall surface of the hole wall portion 32*a*. At this time, the projecting portion 42 on the swinging shaft 41 enters the engaging groove portion 35*a* or 35*b*, and when the flap 122 is rotated, the projecting portion 42 is engaged with the engaging groove portion 35*a* or 35*b*, thereby regulating the swing range of the flap 122.

The fixing of the fixing seat 30 will be described with reference to FIG. 11.

In the case of one fixing seat 30 of the two fixing seat 30, the driving shaft 34*a* of the stepping motor 34 (see FIG. 12) is secured to face the lower side of the paper surface of FIG. 11, and this stepping motor 34 rotates the flap 122 (represented by reference numeral 122L in FIG. 11) secured along the left side of the face panel 100.

With respect to the paper surface of FIG. 11, a joint device (not shown) for joining the lower swinging shaft 41 of the flap 122L and the swinging shaft 41 of the flap 122 secured along the lower side of the face panel 100 is provided at the lower left corner portion (not shown) of the face panel 100. The joint device can directly transmit the rotational driving force of the stepping motor 34 to the flap 122 extending along the lower side of the face panel 100, and also the two flaps 122 are connected to each other so as to be rotatable in-phase.

In the case of the other fixing seat 30 of the two fixing seats, the driving shaft 34*a* of the stepping motor 34 (see FIG. 12) is secured to face the right side of the paper surface of FIG. 11, and the stepping motor 34 rotates the flap 122 (represented by reference numeral 122U in FIG. 11) secured along the upper side of the face panel 100.

With respect to the paper surface of FIG. 11, a joint device (not shown) for joining the swinging shaft 41 at the right side of the flap 122U and the swinging shaft 41 of the flap 122 secured along the right side of the face panel 100 is provided at the upper right corner portion (not shown) of the face panel 100. As in the case of the above-described joint device, this joint device can directly transmit the rotational driving force of the stepping motor 34 to the flap 12 extending along the right side of the face panel 100, and also the two flaps 122 are connected to each other to be rotatable in-phase.

When the swinging shaft 41 is inserted into the cylindrical support portion 32 of the fixing seat 30, the projecting portion 42 on the swinging shaft 41 of the above flap 122L enters the engaging groove portion 35*a* at the left side when viewed in the A direction of FIG. 6. When the swinging shaft 41 is inserted into the cylindrical support portion 32 of the fixing seat 30, the projecting portion 42 on the swinging shaft 41 of the flap 122U enters the engaging groove portion 35*b* at the right side when viewed in the A direction of FIG. 12. That is, the engaging groove portions 35*a* and 35*b* are formed so as to be bilaterally symmetrical with each other, whereby the two fixing seats 30 can be commonly used.

The fixing hole 33 of the fixing seat 30 is disposed to be exposed to the room when the corner panel 102 (see FIG. 1) is detached as shown in FIG. 11. Accordingly, by detaching the corner panel 102, the fixing seat 30 can be exchanged.

Next, the operation of this embodiment will be described.

When the operation of the indoor unit 10 is started, the four flaps 122 located at the air blow-out port 120 are driven by the stepping motors 34 secured to the two fixing seats 30, thereby starting the swinging operation of the flaps 122. At this time, the projecting portion 42 on the swinging shaft 41 of the flap 122 abuts against the end portion of the engaging groove portion 35*a* or 35*b*, whereby the start point of the swing range of the flap 122 is determined. Thereafter, the stepping motor 34 rotates by a predetermined angle in response to a signal from the control circuit, and the swinging range of the flap is determined on the basis of the signal from the control circuit.

According to the indoor unit 10 of the in-ceiling mount type air conditioner according to this embodiment, the swinging shaft 41 of the flap 122 is provided with the projecting portion 42 projecting outward from the outer peripheral surface of the swinging shaft 41, and the engaging grooves 35*a*, 35*b* which abut against the projecting portion 42 to regulate the start point of the swing range of the flap 122 are provided to the hole wall portion 32*a*. Therefore, the start point of the swing range of the flap 122 can be regulated by the cylindrical member 32 located in the neighborhood of the fixing portion of the stepping motor 34. Therefore, even when the wind direction plate 40 of the flap 122 is warped due to heat of blown-out air or the like, the projecting portion 42 is not affected by the warp of the wind direction plate 40, and thus the displacement between the projecting portion 42 and the engaging groove portions 35*a*, 35*b* can be prevented. As a result, heat-exchanged air can be fed to a predetermined area under air-conditioning operation.

Since the engaging groove portions 35*a*, 35*b* are symmetrically formed in the hole wall portion 32*a*, the projecting portion 42 can be made to abut against the engaging groove portion 35*a*, 35*b* even when the fixing direction of the flap 122 to the fixing seat 30 is reversed. Therefore, it is unnecessary to provided plural kinds of fixing seats 30, and thus the parts can be made common by using one fixing seat 30.

Furthermore, the hole portion in which the swinging shaft 41 is inserted is constructed by the cylindrical member 32, whereby the hollow portion 32*b* and the engaging groove portions 35*a*, 35*b* can be easily formed, and the cost can be reduced.

When the corner panel 102 is detached, the fixing hole 33 of the fixing seat 30 is disposed to be exposed to the room. Therefore, by detaching the corner panel 102, the fixing seat 30 can be easily exchanged, so that the maintenance can be enhanced.

The prevent invention is not limited to the above embodiment, and various modifications and alterations may be made on the basis of the technical idea of the present invention.

In the above embodiment, the cylindrical member 32 is provided to the fixing seat 30, and the swinging shaft 41 is inserted in the cylindrical member 32. However, another structure may be adopted. For example, a hole portion which is the same as the arcuate portion 41*b* of the swinging shaft 41, and a groove portion for regulating the movable range of the projecting portion 42 may be provided to the hole portion.

Third Embodiment

Figure 14:
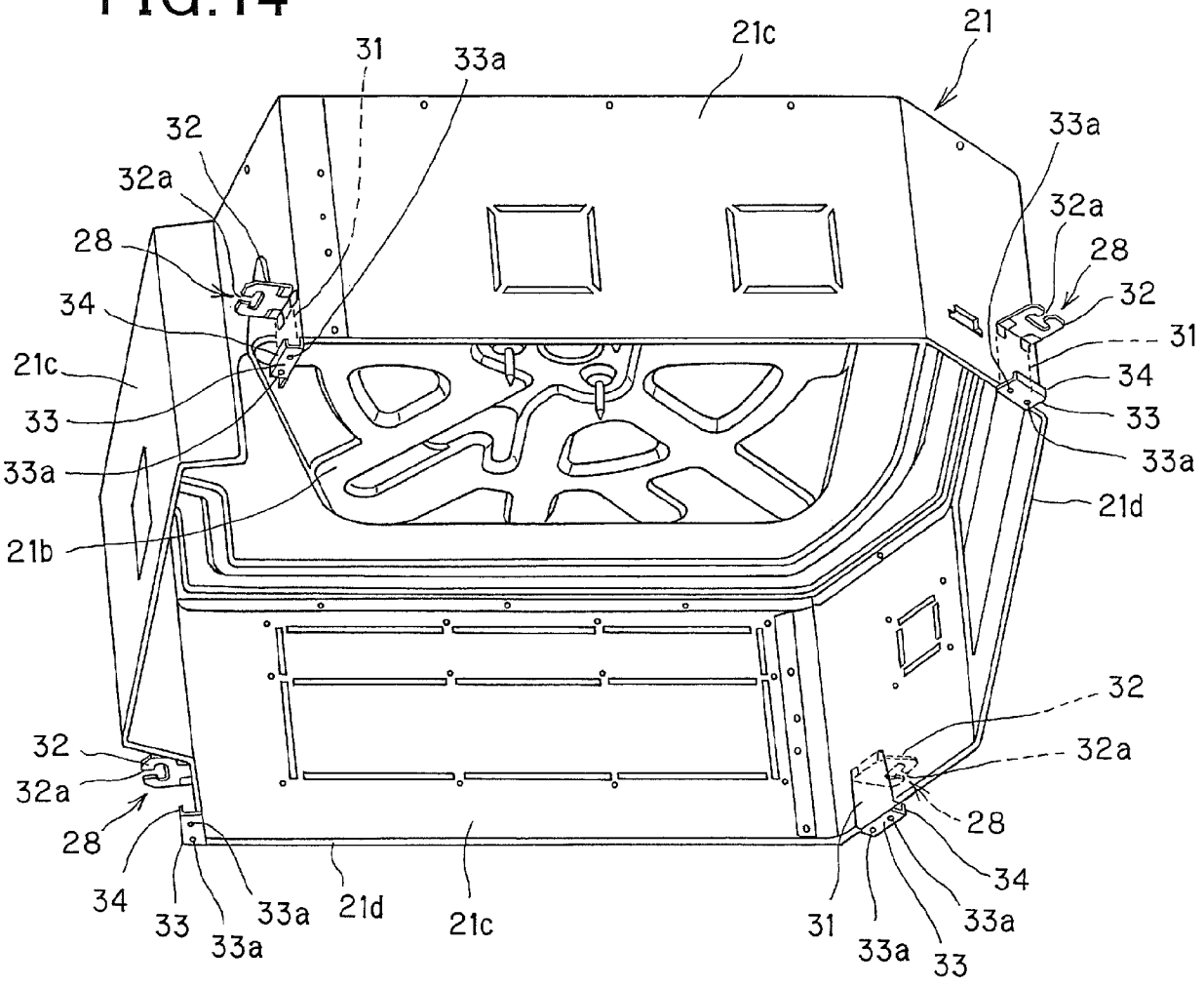
FIG. 14 is a perspective view showing the housing to which suspending fittings are assembled.
Figure 15:
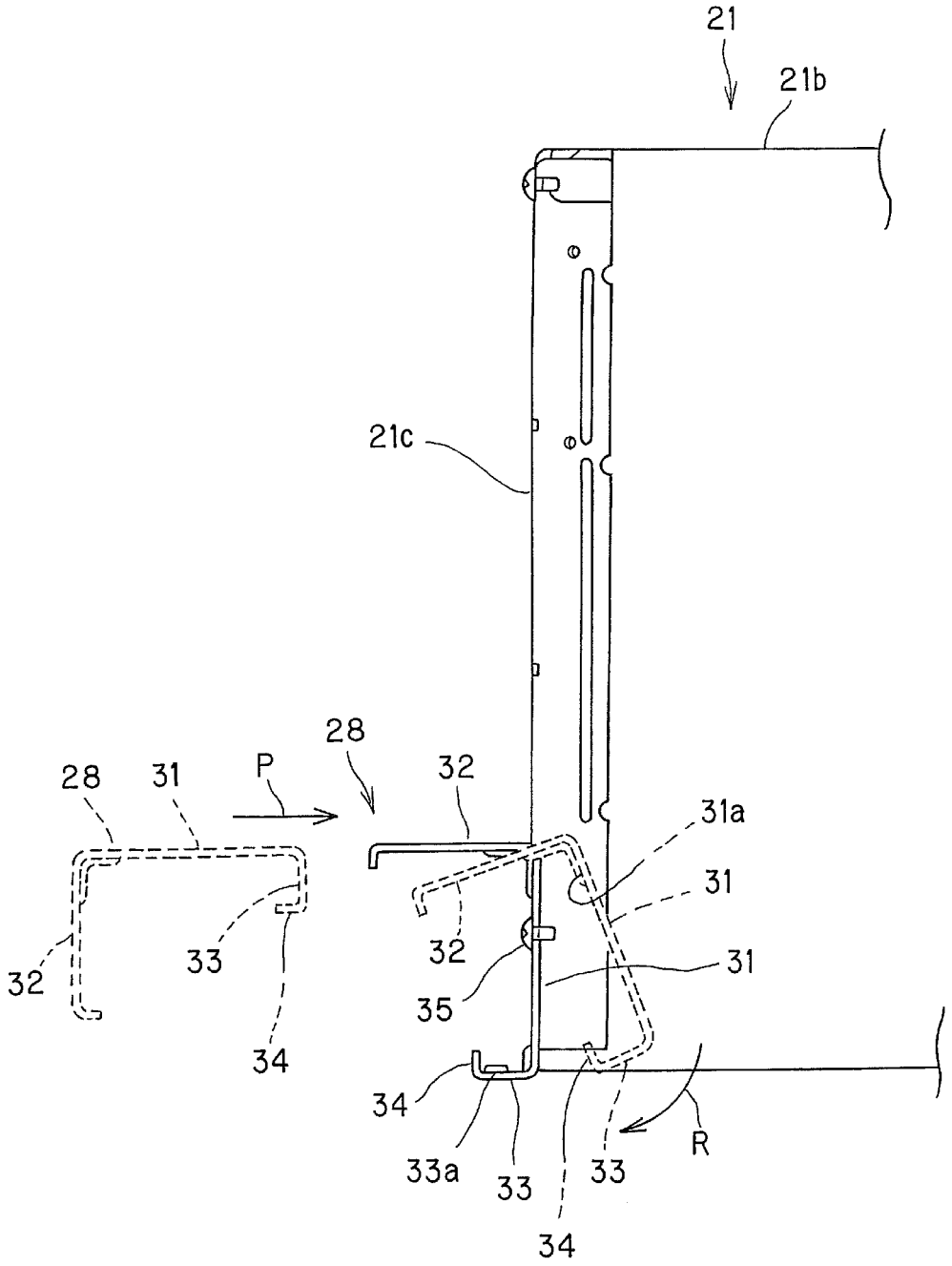
FIG. 15 is a diagram showing a procedure of assembling the suspending fittings to the housing.

FIG. 14 is a perspective view showing the housing 21 assembled to the suspending fittings 28, and FIG. 15 is a diagram showing a assembling process of the suspending fittings 28 to the housing 21.

As described above, the suspending fittings 28 are respectively fixed to the four corners of the housing 21, and the suspending bolts 129 penetrate through the suspending fittings 28, whereby the housing 21 is suspended from the ceiling by the suspending bolts 129. As shown in FIG. 15, each of the suspending fittings 28 comprises a first portion 31 extending in the housing 21, a second portion 32 and a third portion 33. The second portion 32 extends substantially in parallel to the top plate portion 21*b* at the outside of the housing 21 when the first portion 31 is inserted through an opening (not shown) formed in the housing 21 in a direction of an arrow P and then rotated in a direction of an arrow R until the confronting surface 31*a* of the first portion 31 abuts against the inner surface of the side plate portion 21C of the housing 21, and has a groove 32*a* (FIG. 14) through which the suspending bolt 29 penetrates. The third portion 33 is fitted to the lower end edge 21*d* of the side plate portion 21*c* of the housing 21 to support the lower end edge 21*d* when the first portion 31 is inserted through the opening (not shown) formed in the housing 21 in the direction of the arrow P and then rotated in the direction of the arrow R until the confronting surface 31*a* of the first portion 31 abuts against the inner surface of the side plate portion 21*c* of the housing 21.

More specifically, the suspending fitting 28 is designed in a substantially U-shaped fitting in which the second portion 32 and the third portion extend from the upper and lower ends of the first portion 31 in parallel to each other. The first portion 31, the second portion 32 and the third portion 33 are integrally formed by subjecting one plate material to press working, for example. Therefore, the suspending fittings 28 can be easily formed, and the manufacturing cost can be reduced.

As shown in FIG. 15, the suspending fitting 28 is fixed to the side plate portion 21*c* of the housing 21 by a screw 35 under the state that the confronting surface 31*a* of the first portion 31 abuts against the inner surface of the side plate portion 21*c* of the housing 21. In this case, the second portion 32 abuts against the upper edge of the opening (not shown) formed in the housing 21, and the third portion 33 is hooked to the lower end edge 21*d* of the side plate portion 21*c* of the housing 21. Accordingly, the suspending fitting 28 is constructed so as to receive the weight of the housing 21 by itself. Therefore, the screw 35 exclusively functions to join the suspending fitting 28 and the side plate portion 21*c*, and the screw 35 itself does not receive the weight of the housing 21. Accordingly, even if the screw 35 loosens, the suspending fitting 28 supports the housing 21 by the second portion 32 and the third portion 33, and thus the suspending fitting 28 is prevented from being released from the housing 21.

The suspending fitting 28 suspends the main body of the indoor unit 20 from the beam through the suspending bolt 129, and when the height of the indoor unit main body 20 is changed, the suspending bolt 129 is adjusted. The corner panels 102 are provided at the positions (four corners) corresponding to the suspending fittings 28. Accordingly, when the corner panel 102 is detached, the suspending fittings 28 are exposed, and thus the suspending bolts 129 can be easily accessed. Accordingly, there is a merit that the suspending fittings 28 can be easily accessed from the outside by merely detaching the corner panels 102.

In this embodiment, the suspending fitting 28 has a temporal tacking portion 34 for temporarily tacking the face panel 100 (FIG. 1) to the third portion 33 as shown in FIG. 15. The temporal tacking portion 34 is a pawl portion formed by bending the tip portion of the third portion 33 upwardly, and it is formed integrally with the first portion 31 and the second portion 32 by press working.

Furthermore, the suspending fitting 28 has a screw hole 33*a* formed in the third portion 33 as shown in FIG. 14. The screw holes 33*a* are used when the face panel 100 is fixed to the housing 21 by screws, and they function as an actual fixing portion.

As described above, by providing the temporal tacking portion 34 to the third portion 33 of the suspending fitting 28, the temporal tacking portion 34 can be easily accessed under the state that the corner panel 102 is detached, and thus the face panel 100 can be temporarily tacked to the temporal tacking portion 34. Furthermore, it is unnecessary to provide the temporal tacking portion separately from the suspending fitting, so that the number of parts can be reduced and further the manufacturing cost can be reduced. Still furthermore, the screw hole 33*a* is formed in the third portion 33 of the suspending fitting 28. Accordingly, after the face panel 100 is temporarily tacked, a worker can actually fix the face panel 100 to the housing 21 without changing the position of a stepladder on which he rides, so that the workability can be enhanced.

Figure 16:
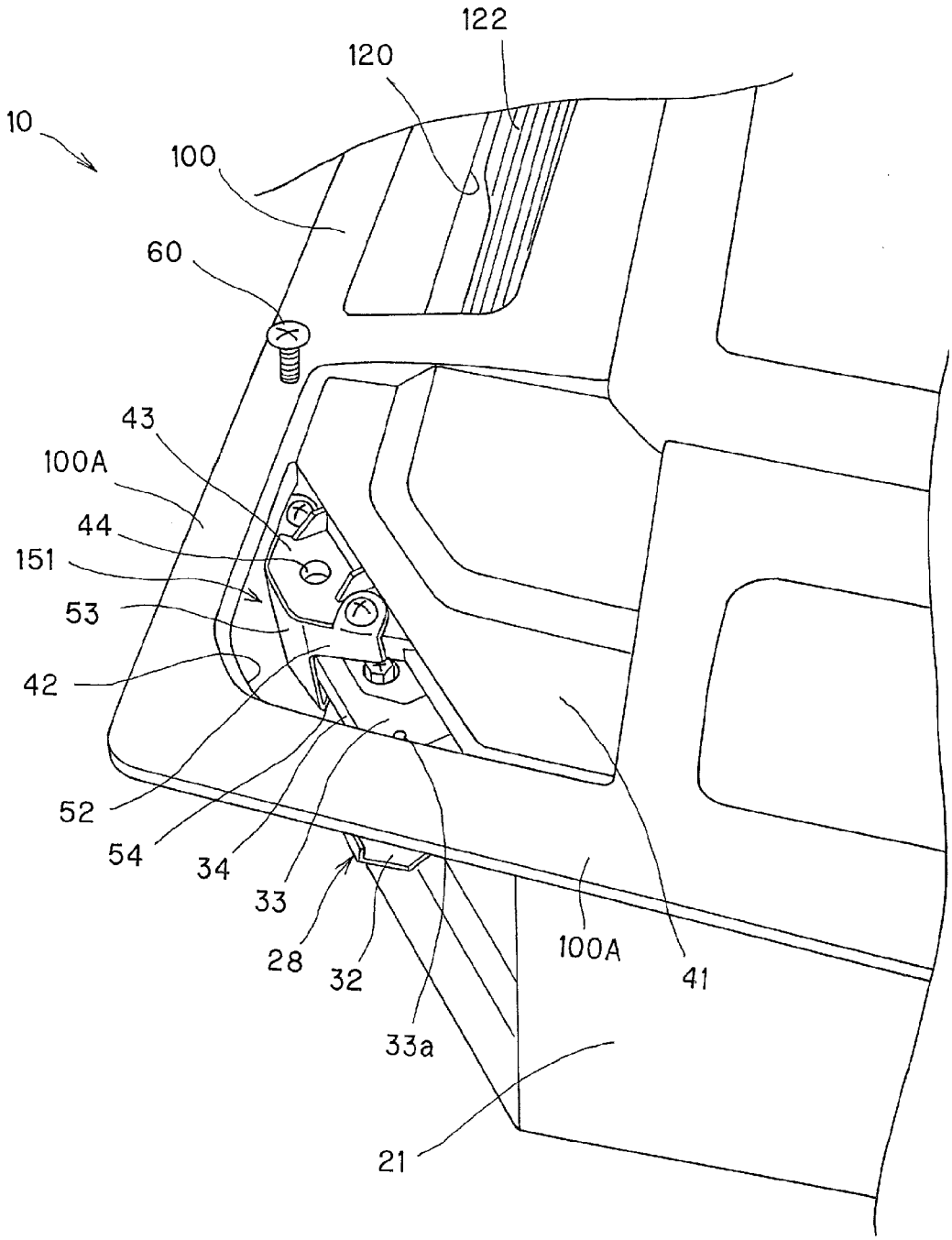
FIG. 16 is a perspective view showing a face panel from which a corner panel is detached.

FIG. 16 is a perspective view showing a corner portion of the face panel 100 from which the corner panel is detached. In FIG. 16, the state of the indoor unit 10 when the indoor unit 10 is suspended is reversed.

The corner portion of the face panel 100 has a recess portion 41 which is more recessed as compared with the surface of the face panel 100, and an opening portion 42 formed by the recess portion 41 and the edge portion 100A of the face panel 100 as shown in FIG. 16. The recess portion 41 and the opening portion 42 are covered by the corner panel 102 (FIG. 1). The opening portion 42 is formed at the position corresponding to the suspending fitting 28 provided to the housing 21, and the suspending fitting 28 can be accessed through this opening portion 42.

In this construction, the recess portion 41 has a seat 43 obtained by projecting a part of the recess portion 41 to the opening portion 42 side, and the seat 43 has a through hole 44 for fixing the face panel 100 to the housing 21.

A hook member 151 which is hooked to the temporal tacking portion 34 is provided to the edge portion of the seat 43. The hook member 151 is formed by bending a metal plate such as a leaf spring material or the like, and it has a base portion 52 fixed to the seat 43, an elastic portion 53 which continuing to the base portion 52 and extends upwardly (downwardly in FIG. 16), and a hook portion 54 which is hooked to the temporal tacking portion 34 by bending the tip portion of the elastic portion 53 inward. The hook portion 54 is formed so as to intersect to the elastic portion 53 at an angle of about 45°. The base portion 52 extends from the edge portion of the seat 43 to the lower surface of the seat 43 (the upper surface in FIG. 16), and it is fixed to the seat 43 by a screw 45. As described above, in this construction, the hook member 151 is provided to the edge portion of the opening portion 42, and thus it does not close the opening portion 42 and obstruct the working.

Furthermore, the hook member 151 is provided to the edge portion of each of a pair of diagonally-located opening portions 42 out of the opening portions 42 of the face panel 100 (not shown). Accordingly, in the case of a mini-cassette type indoor unit 10 having a small outside width, the worker can attach and detach the face panel 100 alone by operating each of the hook members 51 provided at the diagonal positions of the face panel 100 with one hand.

Figure 17:
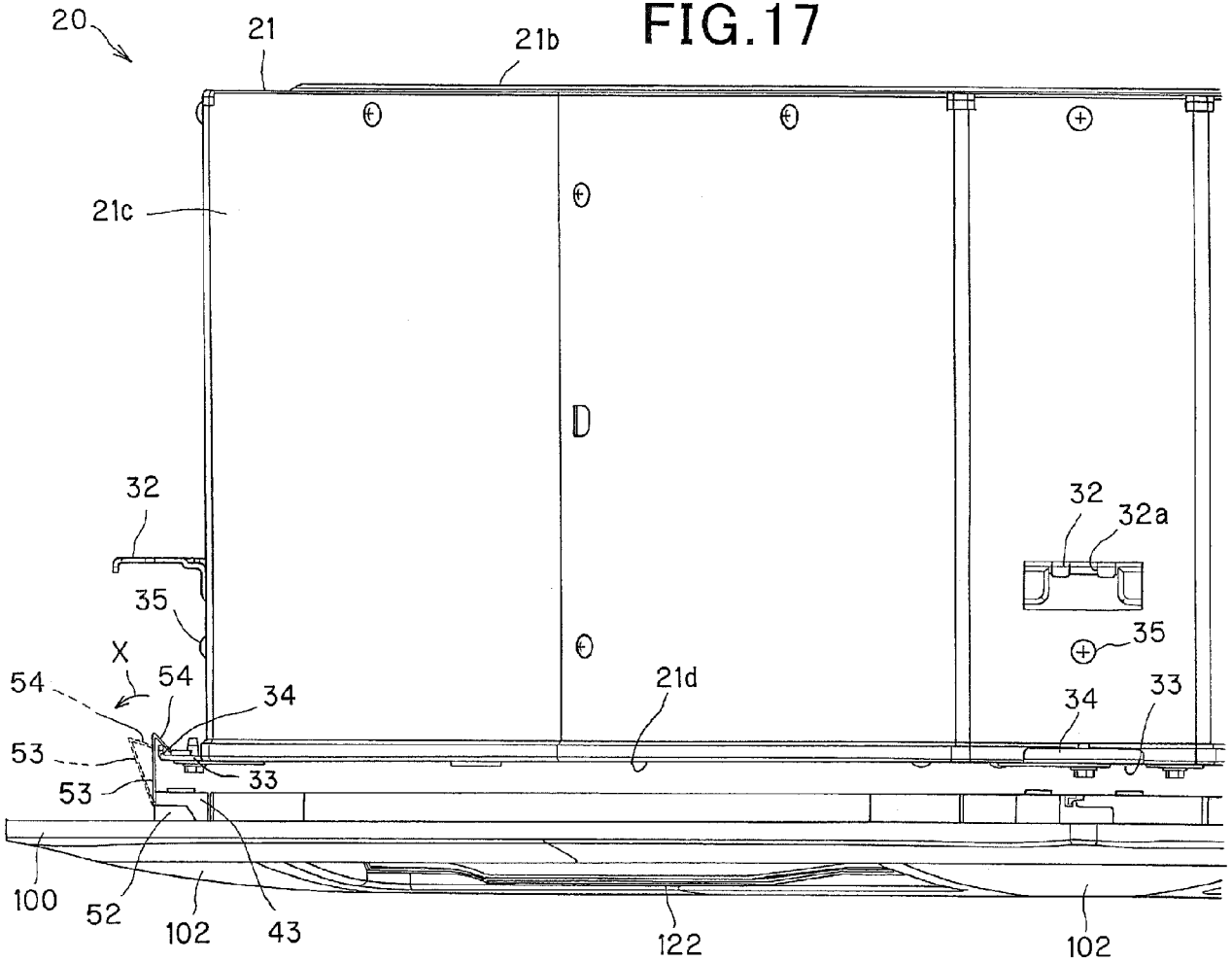
FIG. 17 is a diagram showing a procedure of fixing the face panel.

Next, the procedure of fixing the face panel 100 to the housing will be described with reference to FIG. 17.

First, each of the opening portions 42 located at the diagonal positions is gripped by hand and the upper end (that is, the hook portion 54) of the hook member 151 provided to the opening portion 42 is spread outward (in the direction of an arrow X in FIG. 17) by a finger. Under this state, the face panel 100 is lifted up, and the hook portion 54 of the hook member 151 is hooked to the temporal tacking portion 34 of the suspending fitting 28. In this construction, the hook member 151 is formed of a leaf spring material, and thus the elastic portion 53 is returned to the original state by releasing the finger from the hook portion 54, whereby the temporal tacking portion 34 of the suspending fitting 28 and the hook portion 54 of the hook member 151 are hooked to each other, and the face panel 100 is temporarily tacked to the housing 21.

Subsequently, the screw 60 is inserted into the through hole 44 (FIG. 16) formed in each seat 43 of the face panel 100, and the screw 60 is fixed into the screw hole 33 formed in the third portion of each suspending fitting 28. Accordingly, the face panel 100 can be easily fixed to the housing 21. Furthermore, when the face panel 100 is detached, the fixing procedure may be performed in the reverse order.

As described above, according to this embodiment, in the in-ceiling mount type air conditioner which has the housing 2 for accommodating the air blower 23 and the indoor heat exchanger 24 therein, the face panel 100 disposed at the lower side of the housing 21, and the suspending fittings 28 provided to the side plate portion 21C of the housing 21 and in which the housing 21 is suspended from the beam and supported by inserting the suspending bolts hung from the beam through the suspending fittings 28, each of the suspending fittings 28 comprises the first portion 31 extending in the housing 21, the second portion 32 which extends to the outside of the housing 21 through the opening formed in the housing 21 so as to be substantially parallel to the top plate portion 21*b*, and the third portion 33 which is hooked to the lower end edge 21*d* of the side plate portion 21*c* of the housing 21 to support the lower end edge 21*d* of the side plate. The third portion 33 is provided with the temporal tacking portion 34 for temporarily tacking the face panel 100. Therefore, by using a part of the suspending fitting 28, the face panel 100 can be temporarily tacked to the suspending fitting 28, and the construction for temporarily tacking the face panel 100 is simplified. Furthermore, it is unnecessary to provide the temporal tacking portion 34 separately. Accordingly, the number of parts can be reduced, and further the manufacturing cost can be reduced.

According to this embodiment, the third portion 33 has the screw hole 33*a* through which the temporarily tacked face panel 100 is actually fixed to the housing 21, and thus the temporal tacking and the actual fixing of the face panel 100 to the housing 21 can be performed by using the third portion 33 of the suspending fittings 28, and the construction of fixing the face panel 100 can be simplified. Furthermore, the screw hole 33*a* and the temporal tacking portion 34 are provided to the third portion 33 of the suspending fitting 28. Therefore, after the face panel 100 is temporarily tacked, the face panel 100 can be actually fixed to the housing 21 without changing the position of the stepladder on which the worker rides, and thus the workability can be enhanced.

Furthermore, according to this embodiment, the temporal tacking portion 34 is formed by bending the tip portion of the third portion 33, so that the temporal tacking portion 34 can be easily formed, and the structure of temporarily tacking the face panel 100 can be simplified.

Still furthermore, according to this embodiment, the face panel 100 has the opening portions 42 covered by the corner panels 102 at the four corners of the face panel 100 in connection with the suspending fittings, a pair of opening portions 42 out of the four opening portions 42, which are located at the diagonal positions of the face panel 100, are provided with the hook members 151 which are hooked to the temporal tacking portions 34, and thus the hook members 51 can be easily accessed by detaching the corner panels 102. Accordingly, the hook members 51 and the temporal tacking portions 34 can be easily hooked/unhooked to/from each other. Furthermore, the hook members 51 are provided to the opening portions 42 located at the diagonal positions. Therefore, in the case of a so-called mini-cassette type indoor unit 10 having a small outside width, a worker can easily attach/detach the face panel alone by operating each of the hook members 51 provided at the diagonal positions of the face panel with one hand.

The present invention is not limited to the above embodiment, and various modifications and alterations may be made on the basis of the technique idea of the present invention. In the above embodiment, the temporal tacking portion 34 is formed integrally with the third portion by bending the tip portion of the third portion, however, the present invention is not limited to this style. For example, the temporal tacking portion may be provided separately from the third portion and fixed to the third portion by fastening means such as welding, screw-cramping or the like.

Fourth Embodiment

Figure 18:
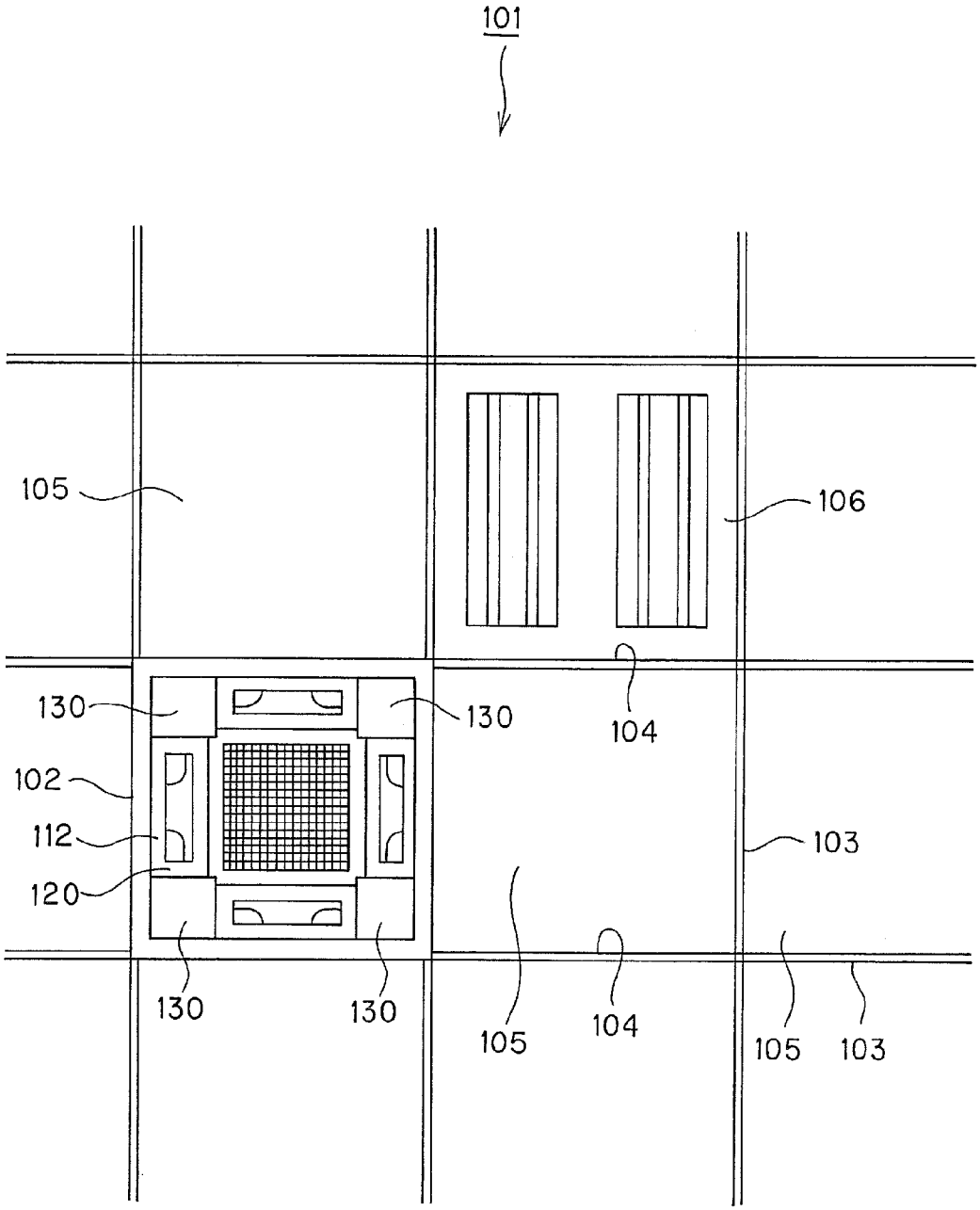
FIG. 18 is a diagram showing a state that an air conditioner of an in-ceiling mount type air conditioner is set up on a grid system ceiling when the air conditioner is viewed from the room side.

FIG. 18 is a diagram showing an air conditioner 102 of an in-ceiling mount type air conditioner 101 according to a fourth embodiment when the air conditioner 2 mounted on a grid system ceiling is viewed from the lower side.

This grid system ceiling has plural holding bars 103 which are suspended from the ceiling through plural suspending members (not shown). These holding bars 103 are set up in a grid pattern, and a holding bar opening portion 104 is formed in each space surrounded by the grid bars 103. In this embodiment, each of the holding bar opening portions 104 has an opening of 600 mm×600 mm in size. A ceiling material 105 which corresponds to the size of the opening and forms a ceiling surface, an illumination unit 6 for illuminating a room, the air conditioner 2 for air-conditioning the room, etc. are secured to the respective holding bar opening portions 4.

Figure 19:
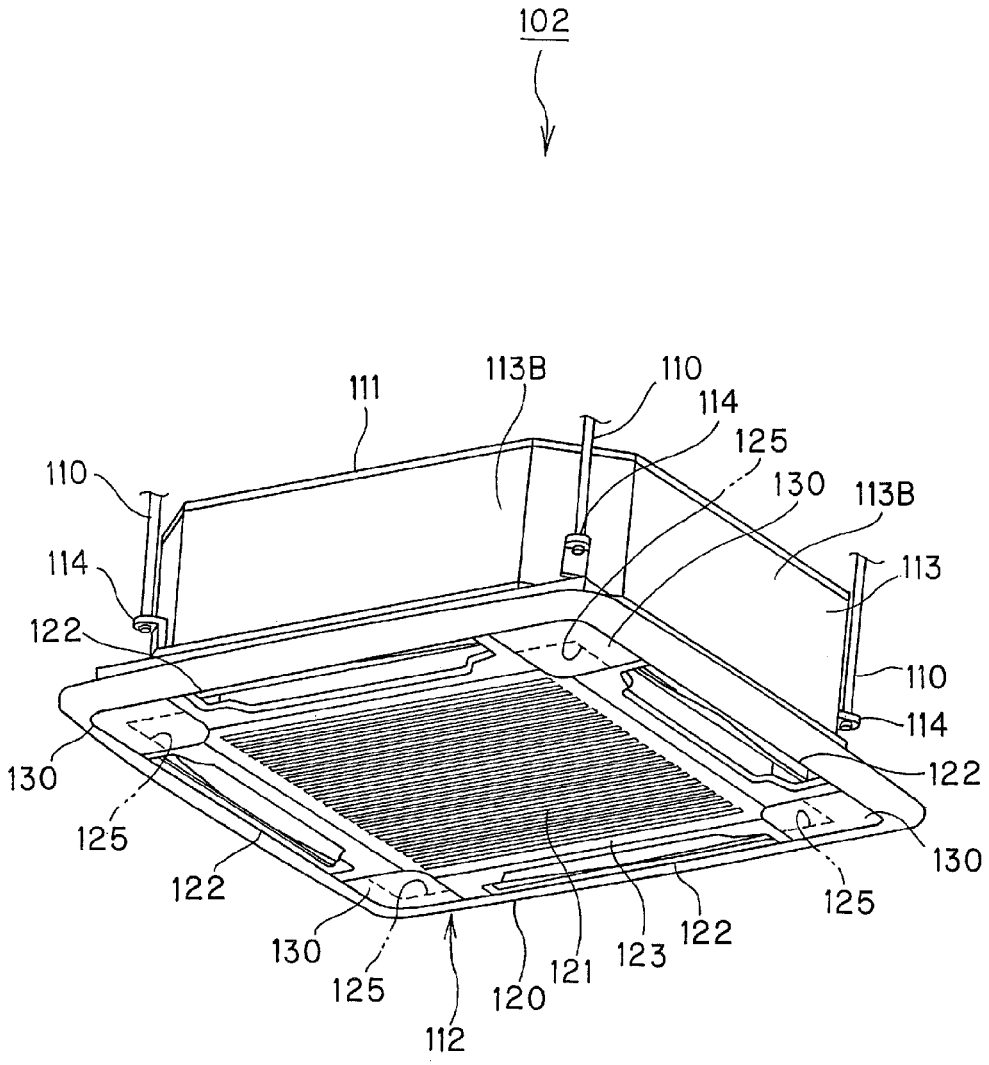
FIG. 19 is a perspective view showing the air conditioner when the air conditioner is viewed from the lower side.
Figure 20:
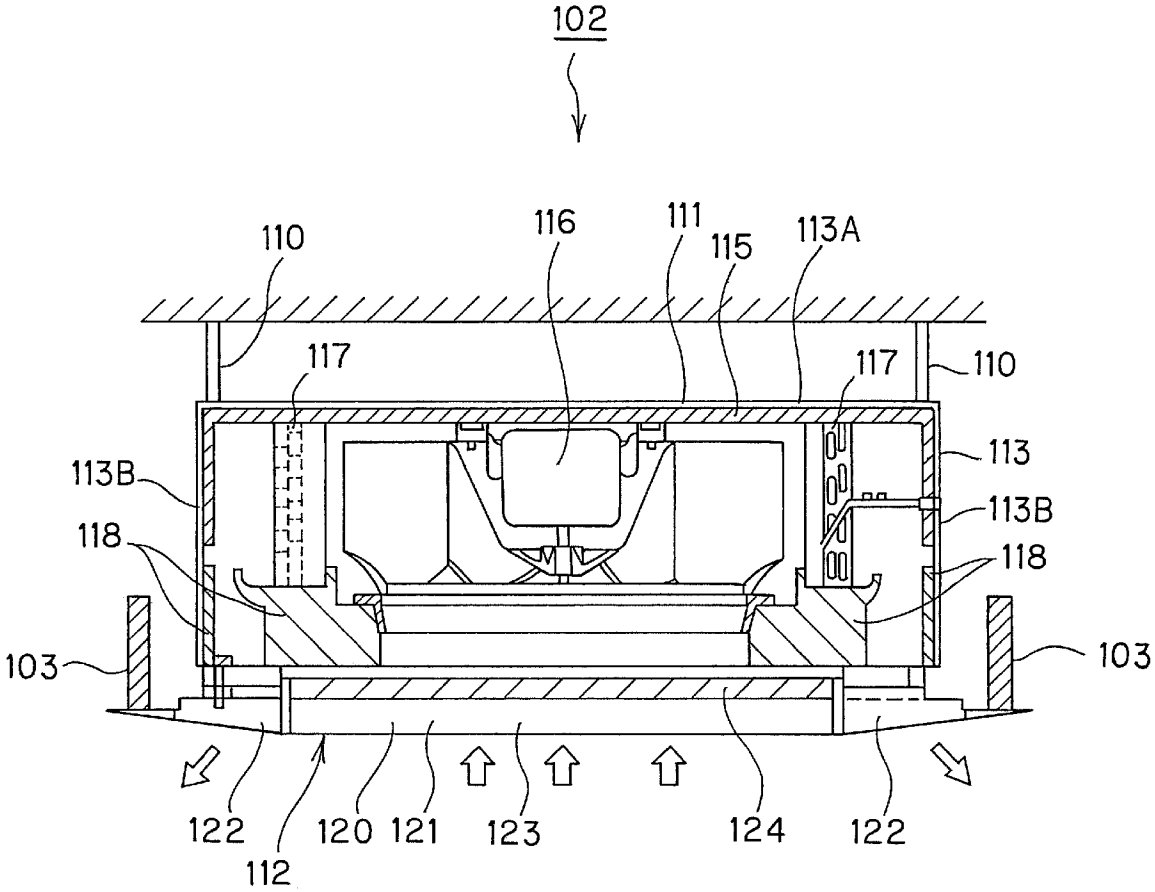
FIG. 20 is a longitudinally-sectional view of the air conditioner.

FIG. 19 is a perspective view showing the air conditioner 102 when viewed from the lower side, and FIG. 20 is a longitudinally-sectional view of the air conditioner 102.

The air conditioner 102 according to this embodiment is a four-way cassette type air conditioner 102 having an outer shape of 600 mm×600 mm which correspond sot the holding bar opening portion 104, and it has an air conditioner maim body 111 suspended from the ceiling through suspending bolts 110 and a face panel 112 secured to the lower surface of the air conditioner main body 11 as shown in FIGS. 19 and 20.

As shown in FIGS. 19 and 20, the air conditioner main body 111 has a housing 113 constituting the outer shape portion of the air conditioner 111. The housing 113 is formed in a substantially box shape having an opening at the lower surface thereof, and has a top plate portion 113A and a side plate portion 113B. As shown in FIG. 19, suspending fittings 114 are provided at the four corner portions of the outer surface of the side plate portion 113B, and the suspending bolts 110 hung from the ceiling are secured to the suspending fittings 114, whereby the housing 113 is suspended by the suspending bolts 110 and supported on the ceiling.

As shown in FIG. 20, a heat insulating material 115 formed of foamed polystyrene is provided on the whole inner surface of the top plate portion 113A and the side plate portion 113B of the housing 113 as in the case of the first embodiment. An air blowing fan 116 is fixed to the top plate portion 113A of the housing 113, and an indoor heat exchanger 117 is provided so as to surround the air blowing fan 116. Air which is sucked through an air suction port 121 (described later) of the face panel 112 by the air blowing fan 116 is fed to the indoor heat exchanger 117, and also air heat-exchanged in the indoor heat exchanger 17 is blown out from an air blow-out port 22 (described later) of the face panel 12. A drain pan 18 formed of foamed polystyrene for receiving dew condensation water dropped from the indoor heat exchanger 17 is disposed below the indoor heat-exchanger 17.

The face panel 112 has a face panel body 120 which is designed to be substantially rectangular in plan view as shown in FIG. 19, and the face panel body 120 has an air suction port 121 formed substantially at the center of the face panel body 120, and an air blow-out port 122 formed in the neighborhood of each of four sides of the face panel body 120 so as to be along each side of the face panel body 120. An air suction grille 123 is freely detachably mounted at the air suction port 121, and a filter 124 for removing dust contained in air flowing through the air suction port 21 into the housing 113 is mounted in the air suction port 121. The air conditioner 102 sucks indoor air through the air suction port 121 into the housing 113, heat-exchanges the air in the housing 13 and then blown out through the air blow-out port 22 into the room.

Furthermore, at the four corners of the face panel body 120, face panel side openings 125 are formed below the suspending fittings 114 as shown in FIG. 19 (see FIGS. 21 and 23), and corner panels 130 are freely detachably mounted on the face panel body 20 so as to cover the face panel side openings 125. As in the case of the first to third embodiments, when the air conditioner 2 is positioned or the height thereof is adjusted, a worker or the like detaches the corner panel 130 to expose the face panel side opening 25, inserts a hand or a tool into the face panel side opening 125 to access the suspending bolt 110, and operates the suspending bolt 110 to position the air conditioner 2 or the like. Therefore, the corner panel 130 is required to be easily attachable/detachable at the work time so that the work can be performed easily and quickly, and in order to implement the easiness of the attachment/detachment of the corner panels, the face panel body 120 and the corner panels 130 according to this embodiment are constructed as follows.

Figure 21:
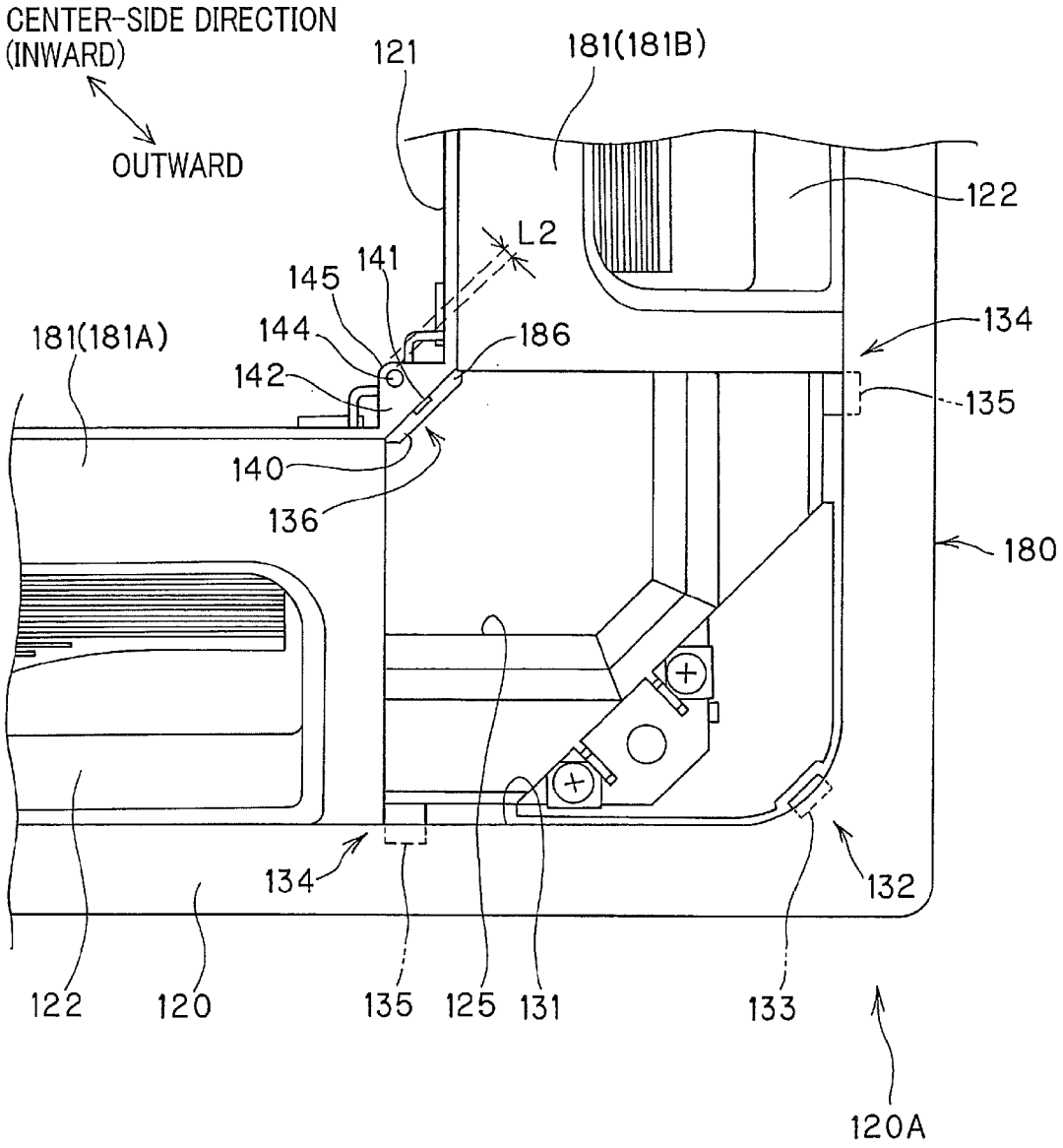
FIG. 21 is a diagram showing one corner portion of the face panel body when viewed from the room side.
Figure 22:
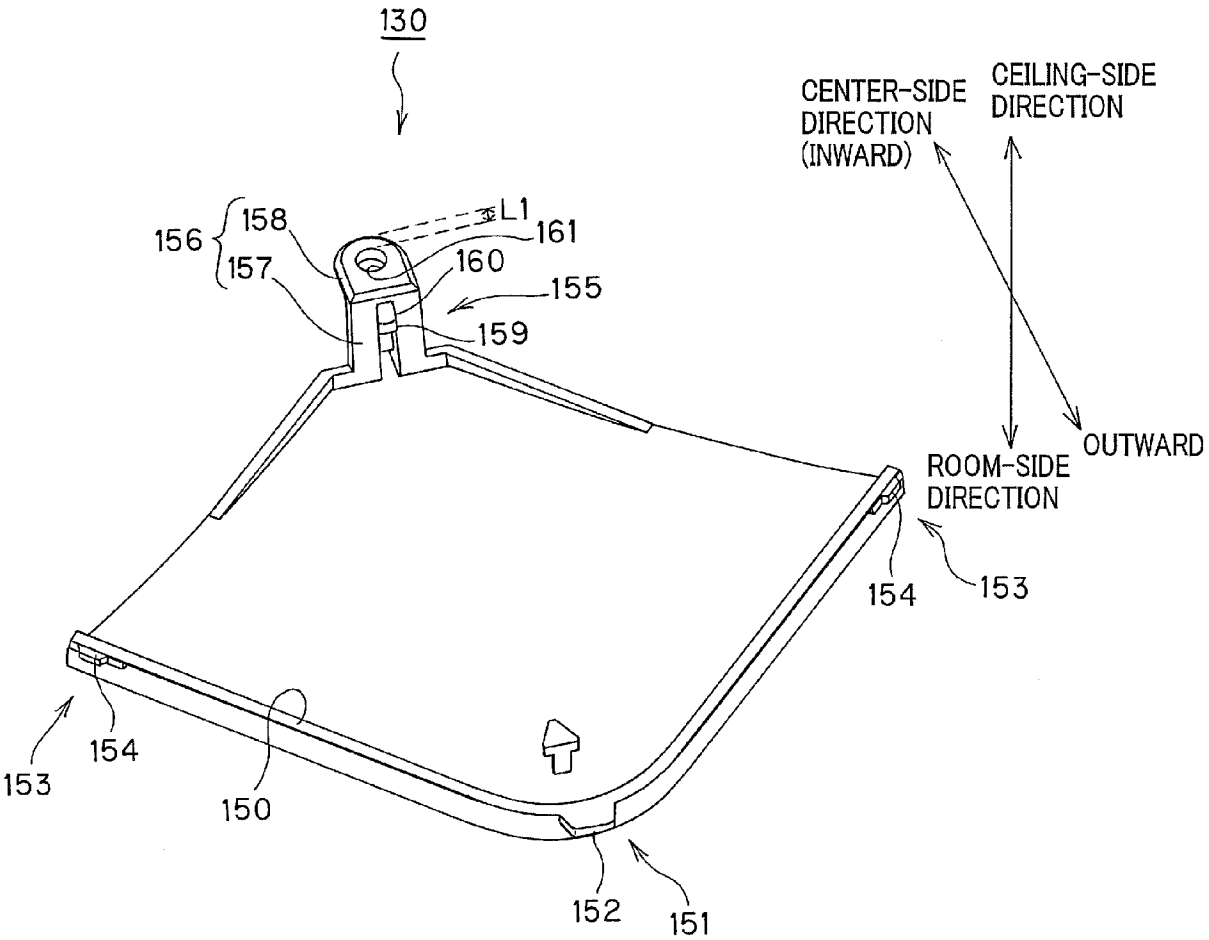
FIG. 22 is a perspective view of a corner panel when viewed from the back side.
Figure 23:
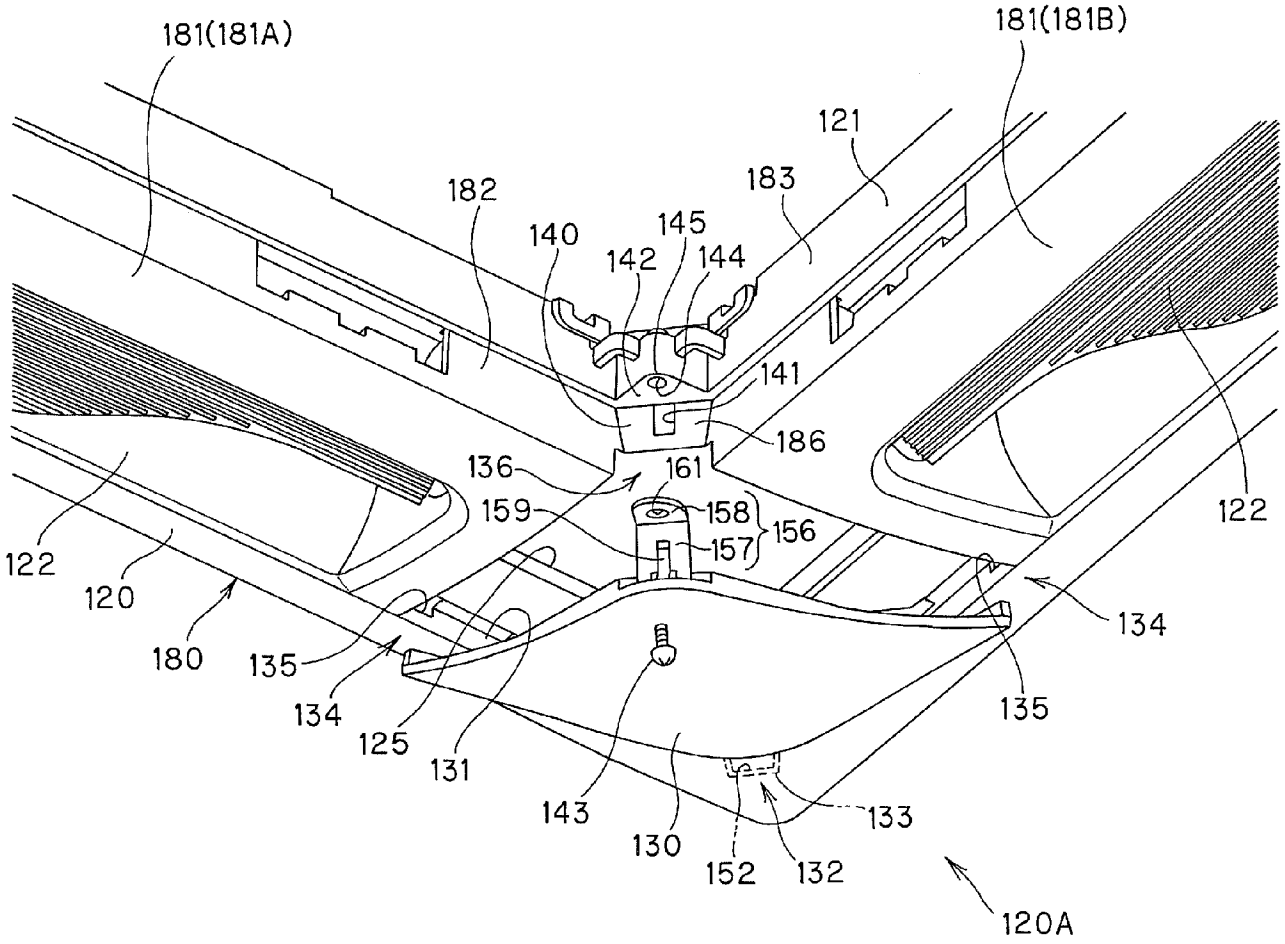
FIG. 23 is a diagram showing a state before the corner panel is secured to the face panel body.
Figure 24:
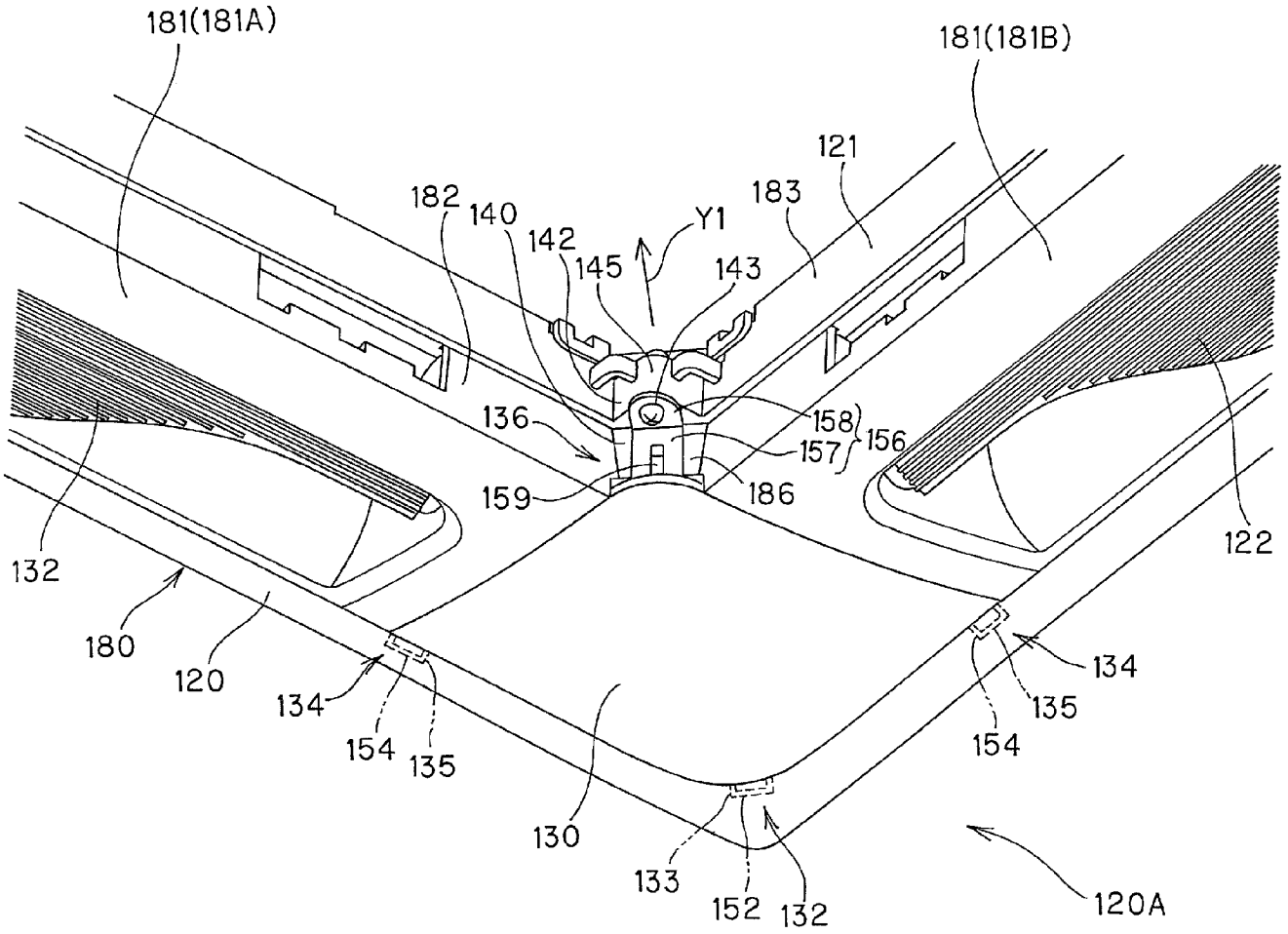
FIG. 24 is a diagram showing a state after the corner panel is secured to the face panel body.

FIG. 21 is a diagram showing one corner portion 120A of the four corner portions of the face panel body 120 when viewed from the room side, and shows the state that the corner panel 130 and the suction grille 123 are detached. FIG. 22 is a perspective view of the corner panel 130 when viewed from the back surface of the corner panel 130. Here, the back surface of the corner panel 130 is a surface of the corner panel 130 which faces the space under the roof when the corner panel 130 is secured to the face panel body 120. FIGS. 23 and 24 are diagrams showing a way of attaching/detaching the corner panel 130 to/from the face panel maim body 120. FIG. 23 shows the state before the corner panel 130 is attached to the face panel body 120, and FIG. 24 shows the state after the corner panel 130 is attached to the face panel body 120. In the following description, the four corner portions of the face panel 112 have substantially the same construction, and thus they will be described hereunder by representatively using one corner portion 120A. Likewise, the four corner panels 130 provided at the four corners of the face panel body 120 have substantially the same construction, and thus they will be described hereunder by representatively using one corner panel 130.

First, the corner portion 120A of the face panel body 120 to which the corner panel 130 is secured will be described.

As shown in FIG. 4, the face panel body 120 has a frame body 180 which is designed in a frame shape so as to surround the air blow-out ports 122, and the frame body 180 has four frame members 181. The two frame members 181A and 181B shown in FIG. 21 are orthogonal to each other at the corner portion 120A of the face panel body 120, and the corner portion 120A is formed by the penetration of the face panel side opening 25 to the side under the roof. A fitting opening portion (hereinafter referred to as opening portion) 131 in which the corner panel 130 is fitted is formed at the room side of the face panel side opening 25. The opening portion 131 is designed to be substantially rectangular in conformity with the shape of the corner panel 130 so that the corner panel 130 is fitted in the opening portion 131. On the inner peripheral edge of the opening portion 131, an outward-recessed outside engaging hole 133 is formed at the inner peripheral edge of the outer corner portion 132 formed in the direction to the outside (the outward direction indicated by an arrow in FIG. 21, and this direction will be referred to as "outward direction") out of the four corner portions of the opening portion 131. the outside engaging hole 133 is an engaging hole in which an outer engaging pawl 152 (FIG. 22) of the corner panel 130 described later is fitted.

On the inner peripheral edge of the opening portion 131, side engaging holes 35 are formed at the inner peripheral edges of the two side corner portions 134 adjacent to the outer corner portion 132 out of the four corner portions of the opening portion 131 as shown in FIGS. 21 and 23. The side engaging holes 135 are engaging holes in which side engaging pawls 54 (FIG. 22) of the corner panel 130 described later are fitted.

Furthermore, a corner inner wall portion 140 is formed at the center corner portion 136 formed in the center direction out of the four corner portions of the opening portion 131.

As shown in FIGS. 21 and 23, the corner inner wall portion 140 is a member for joining the end portions of respective inner wall surfaces 182, 183 (FIGS. 23 and 24) of the two frame members 181A and 181B, and it has a partition plate 186 and a seat portion 142.

The partition plate 186 is a plate-shaped member through which the opening portion 131 and the air suction port 121 are partitioned from each other, and it extends to the room while inclined from the face panel body 120 outward. An inner wall surface side engaging hole 141 is formed in the partition plate 86 by cutting out the partition plate 186 as shown in FIG. 23. This inner wall surface side engaging hole 141 is an engaging hole in which a projecting portion 159 formed in a joint leg 156 of the corner panel 130 described later is fitted. Here, the partition plate 186 is inclined in the outward direction because the projecting portion 159 (FIG. 22) of the joint leg 156 of the corner panel 130 is guided to the inner wall surface side engaging hole 141 when the corner panel 130 is fitted in the opening portion 131 although it will be described in detail later.

The seat portion 142 is provided to the air suction port 21 side of the base end portion of the corner inner wall portion 140. The seat portion 142 is a site against which a tab portion 158 (FIG. 22) of the joint leg 156 of the corner panel 130 described later abuts, and the tab portion 158 is fixed to the seat portion 142. the seat portion 142 has a seat projecting portion 145 projecting to the air suction port 121 side (in the direction to the center). The seat projecting portion 145 is provided with a female screw portion 144 on which a fixing screw 143 for fixing the corner panel 130 to the face panel body 120 is threadably mounted.

This seat projecting portion 145 is formed so as to project to the air suction port 121 side. Accordingly, when the air suction grille 123 is fixed to the air suction port 121, the seat projecting portion 145 and the fixing screw 143 threadably mounted on the female screw portion 144 of the seat projecting portion 145 are not viewed from the room, so that the exterior appearance is enhanced.

As shown in FIG. 22, the corner panel 130 is designed to have the rectangular shape corresponding to the shape of the opening portion 131, and a corner-panel outer peripheral wall 50 projecting to the ceiling side is formed so as to stride over two outer sides out of the four sides of the corner panel 130. In the corner-panel outer peripheral wall 150, an outward-projecting outside engaging pawl 152 is formed at the outside corner portion 151 out of the four corner portions of the corner panel 130. The outside engaging pawl 152 is fitted in the outside engaging hole 133 (FIG. 21) of the opening portion 131.

Furthermore, in the corner panel outer peripheral wall 150, side engaging pawls 154 to be fitted in the side engaging holes 135 (FIGS. 21, 23) of the opening portion 131 are formed at the two side corner portions 153 adjacent to the outside corner portion 151. Furthermore, a joint leg 156 is provided at the center corner portion 155 formed at the center side out of the four corner portions of the corner panel.

The joint leg 156 is formed of material having elasticity, and it has an erecting portion 157 projecting to the ceiling side, and a tab portion 158 which is formed so as to be clinched from the tip of the erecting portion 157 to the center side as shown in FIG. 22.

The erecting portion 157 is provided with a projecting portion 159 projecting outward as shown in FIG. 22. This projecting portion 159 is fitted into the inner wall surface side engaging hole 141 of the corner inner wall portion 140 described above, and a slant portion 160 which is inclined toward the center side is formed on the outside surface of the projecting portion 159. This slant portion 160 guides the projecting portion 159 to the inner wall surface side engaging hole 141 when the corner panel 130 is fitted in the opening portion 131.

Furthermore, the tab portion 158 is brought into contact with the seat portion 142 described above and fixed to the seat portion 142, and a through hole 161 is formed in the tab portion 158 so as to penetrate in the ceiling-room direction. This through hole 161 is a hole through which the fixing screw 143 penetrates. When the corner panel 130 and the face panel body 120 are fixed to each other, as shown in FIGS. 23 and 24, a dedicated fixing screw 143 is threadably mounted on the female screw portion 144 through the through hole 161, whereby the corner panel 130 is fixed to the face panel body 120 by the screw.

In the tab portion 158, the length L1 (see FIG. 22) of a portion which extends inward from the edge of the through hole 161 in the center direction is set to be longer than the length L2 (FIG. 21) of a portion which extends inward from the edge of the female screw portion 144 of the seat portion 142 in the center direction, and when the corner panel 130 is fitted in the opening portion 131, the tip portion of the tab portion 158 extends inward beyond the seat portion 142 to the center side, and this extended portion can be pinched by the worker or the like. Accordingly, when the corner panel 130 is detached from the opening portion 131, the worker or the like pinches this tab portion 158 and displaces the position of the corner panel 130 through the tab portion 158, whereby the engagement between the corner panel 130 and the opening portion 131 is released.

The procedure of fixing the corner panel 130 to the face panel body 120 is as follows.

That is, the corner panel 130 is temporarily tacked to the opening portion 131 of the face panel body 120 through no fixing screw 143 under the state that the suction grille 123 is detached from the face panel body 120, and then the corner panel 130 and the face panel body 120 are actually fixed to each other by the fixing screw 143. Thereafter, the suction grille 123 is secured to the face panel body 120.

Specifically, as shown in FIG. 23, the outside engaging pawl 152 of the corner panel 130 is hooked to the outside engaging hole 133 of the opening portion 131, and the center corner portion 136 of the corner panel 130 is pressed in to the ceiling side under the state that the outside engaging pawl 152 is fitted in the outside engaging hole 133.

When the corner panel 130 is pressed in to the ceiling side, the side engaging pawls 154 of the corner panel 130 enter the inner periphery of the opening portion 131 and then elastically fitted to the side engaging holes 135. At the same time, the erecting portion 157 of the joint leg 156 of the corner panel 130 and the projecting portion 159 are guided by the slope of the corner inner wall portion 140 and enters the air suction port 121 side of the corner inner wall portion 140. At this time, the projecting portion 159 is guided by the slant portion 60 of the projecting portion 159 so that the projecting portion 159 slides to the ceiling side while coming into contact with the corner inner wall portion 140. In connection with this, the erecting portion 157 is elastically deformed in accordance with the inclination of the slant portion 160 of the projecting portion 159. When the corner panel 130 is further pressed, the projecting portion 159 is guided by the slant portion 160, and enters the inner wall surface side engaging hole 141 of the corner inner wall portion 140, so that the projecting portion 159 is elastically fitted in the inner wall surface side engaging hole 141 and the temporal tacking is finished.

After the temporal tacking, the fixing screw 143 is threadably mounted on the female screw portion 144 formed in the seat projecting portion 145 of the seat portion 142 through the through hole 161 formed in the tab portion 158 of the joint leg 156, thereby performing the actual fixing. After the actual fixing, the suction grille 123 is secured to the air suction port 121. At this time, the seat projecting portion 145 is formed to project to the air suction port 121 as described above, and thus the fixing screw 143 is not exposed after the suction grille 123 is secured as shown in FIGS. 18 and 19.

As described above, according to this embodiment, the temporal tacking of the corner panel 130 can be performed by an easy and simple work of hooking the outside engaging pawl 52 of the corner panel 130 to the outside engaging hole 133 of the face panel body 120 and then pressing the corner panel 130 to the ceil side. Therefore, the work can be made easy and quick. Furthermore, at the temporal tacking time, the corner panel 130 is fitted in the opening portion 131 are fitted at the four corner portions of the corner panel 130, and thus the temporal tacking state of the corner panel 130 can be firmly held. Therefore, the corner panel 130 can be prevented from dropping after the temporal tacking, and thus the safety can be enhanced.

Next, the procedure of detaching the corner panel 130 from the face panel body 120 will be described.

When the corner panel 130 is detached, as shown in FIG. 24, the suction grille 123 is first detached from the face panel body 120, the fixing screw 43 threadably mounted on the seat portion 142 is exposed and then the fixing screw 143 is unscrewed. At this time, even under the state that the fixing screw 143 is detached (under the temporal tacking state), the corner panel 130 does not drop as described above, and thus the worker or the like can perform a work of unscrewing the fixing screw 143 by using both the hands. Therefore, the working efficiency and the working speed can be enhanced, and also the safety can be also enhanced.

After the fixing screw 143 is unscrewed, the tab portion 158 of the joint leg 156 is pinched, the tab portion 158 is displaced to the center side (in the direction indicated by an arrow Y1 in FIG. 24) to elastically deform the erecting portion 157 of the joint leg 156, the projecting portion 159 of the erecting portion 157 is pulled out from the inner wall surface side engaging hole 141 formed in the corner inner wall portion 140 to release the engagement between the projecting portion 159 and the inner wall surface side engaging hole 141, and then the tab portion 158 is pressed down to the room side, whereby the center corner portion 136 of the corner panel 130 is displaced to the room side. In connection with the displacement of the corner panel 130 to the room side, the engagement state between the side engaging holes 135 of the opening portion 131 and the side engaging pawls 154 of the corner panel 130 is released, and the engagement state between the outside engaging hole 133 of the opening portion 131 and the outside engaging pawl 152 of the corner panel 130 is released. Accordingly, the engagement at the four corner portions of the corner panel 130 is released, and the corner panel 130 is detached from the face panel body 120.

As described above, according to this embodiment, the corner panel 130 can be detached from the face panel body 120 by the simple work of pinching the tab portion 158 of the joint leg 156 of the corner panel 130 and elastically deforming the tab portion 158 to displace the corner panel 130 to the room side, and the work can be made easy and quick. Furthermore, in the detaching work, even when the fixing screw 143 is pulled out, the corner panel 130 is prevented from dropping, and thus the safety can be enhanced.

Furthermore, according to this embodiment, the corner panel 130 is detached from the face panel body 120 by pulling out the corner panel 130 in the room-side direction. Here, for example, in the case of a mechanism of detaching the corner panel 130 by sliding the corner panel 130 in the outward direction, the air conditioner 102 and the illumination unit 106 are adjacent to each other ad shown in FIG. 18, the illumination unit 106 exists at a position to which the corner panel 130 slides, and thus the illumination unit 106 obstructs the sliding of the corner panel 130, so that the detaching work is difficult. However, in this embodiment, the corner panel 130 is detached by displacing the corner panel 130 to the room side, and thus for example even when the air conditioner 102 and the illumination unit 106 are adjacent to each other as shown in FIG. 18, there is no case that the illumination unit 106 obstructs the detachment of the corner panel 130 and the detaching work is difficult when the corner panel 130 is detached.

As described above, according to this embodiment, when the corner panel 130 is secured to the face panel body 120, it can be performed by the easy and simple work of engaging the outside engaging pawl 52 of the corner panel 130 with the outside engaging hole 133 of the face panel body 120 and then pressing the corner panel 130 in the ceiling-side direction. Furthermore, when the corner panel 130 is detached from the face panel body 120, it can be performed by the simple work of pinching the tab portion 158 of the joint leg 156 of the corner panel 130, displacing the tab portion 158 in the center-side direction to elastically deform the erecting portion 157 of the joint leg 156, pulling out the projecting portion 159 of the erecting portion 157 from the inner wall surface side engaging hole 141 to release the engagement therebetween, and then displacing the corner panel 130 in the room-side direction through the tab portion 158. As described above, according to this embodiment, the cost can be reduced and the part structure can be simplified without using any special member such as a permanent magnet, a plate, etc. while keeping the easiness of the attachment/detachment of the corner panel 130.

Furthermore, according to this embodiment, the tab portion 158 extending over the seat portion 142 is formed at the tip of the joint leg 156, and thus the tab portion 158 can be easily and surely pinched, so that the work can be made easy and efficient.

Any modification and application may be made in the above embodiment within the range of the present invention. For example, the air conditioner 102 is provided on the grid system ceiling, however, the present invention may be applied to an embedding type air conditioner in which an air conditioner is embedded in an opening provided to the ceiling. The air conditioner 102 of this embodiment is a four-way cassette type air conditioner 102 of 600 mm×600 mm in outer shape, however, the present invention is not limited to this type of air conditioner. For example, the present invention may be applied to an air conditioner of 640 mm×640 mm in outer shape or a two-way type air conditioner.

What is claimed is:

1. An indoor unit of an in-ceiling mount type air conditioner comprising:

a box-shaped housing having a top plate portion at an upper portion thereof;

a side plate portion and an opening portion at a lower portion thereof;

a face panel detachably mounted on the opening portion of the housing;

an indoor heat exchanger through which the inside of the housing is compartmented into a primary side and a secondary side;

a fan motor secured to the top plate portion of the housing that faces the primary side;

a box-shaped heat insulating material that is fitted to an inner surface of the box-shaped housing and comprises a primary side heat insulating material that is provided on the top plate portion of the box-shaped housing so as to face the primary side of the box-shaped housing and configured to have a flat inner surface having no step and extending along an inner surface of the top plate portion of the box-shaped housing, and a secondary side heat insulating material provided to the side plate portion so as to face the secondary side of the box-shaped housing, the primary side heat insulating material being provided with an opening portion through which the fan motor is fixed to the top plate portion, an inner surface of the box-shaped heat insulating material being provided with a step face to which the fan motor is secured, a first groove portion in which wires extending from the fan motor are accommodated, a second groove portion formed around the first groove portion at the same depth as the step face, and a third groove portion that is formed so as to surround the fan motor and is fitted to the indoor heat exchanger so that an upper end portion of the indoor heat exchanger is brought into contact with the third groove portion, the second groove portion being formed in the flat inner surface of the primary heat insulating material which has no step and extends along the inner surface of the top plate portion of the box-shaped housing, and the first groove portion in which the wires are accommodated being formed at the bottom of the second groove portion in the flat inner surface of the primary heat insulating material; and a wire fixing clasp for fixing the wires in the first groove portion and fixing the primary side heat insulating material to the top plate portion of the box-shaped housing so that the primary side heat insulating material is pressed against the top plate portion with no gap therebetween, wherein the first groove portion is formed in the flat inner surface of the primary side heat insulating material between the step face and the third groove portion so as to intercommunicate with the step face and be opened to an opposite side to a securing position of the box-shaped heat insulating material to the top plate portion, the wire fixing clasp is fitted in the second groove portion while covering the opening of the first groove portion, and the outer surface of the wire fixing clasp and the flat inner surface of the primary side heat insulating material range so as to extend on substantially the same plane with no gap therebetween when the wire fixing clasp is fitted in the second groove portion.

2. The indoor unit of the in-ceiling mount type air conditioner according to claim 1, wherein the flat inner surface of the primary side heat insulating material faces the air blower.

3. The indoor unit of the in-ceiling mount type air conditioner according to claim 1, wherein the upper end portion of the indoor heat exchanger and the second groove portion are brought into contact with each other with no gap therebetween.

4. The indoor unit of the in-ceiling mount type air conditioner according to claim 1, wherein the second groove portion and the wire fixing clasp are configured to have substantially the same flat-plate shape so that the wire fixing clasp is fitted into the second groove portion.

5. The indoor unit of the in-ceiling mount type air conditioner according to claim 1, further comprising a fastening member for fastening the wire fixing clasp from the inside of the box-shaped housing through the primary insulating material to the top plate portion of the box-shaped housing so that the primary side heat insulating material is pressed against the top plate portion of the box-shaped housing and no gap occurs between the primary side heat insulating material and the top plate portion of the box-shaped housing.

* * * * *